US011867423B2

(12) United States Patent
Shin et al.

(10) Patent No.: US 11,867,423 B2
(45) Date of Patent: Jan. 9, 2024

(54) HEAT PUMP AND METHOD FOR OPERATING HEAT PUMP

(71) Applicant: LG ELECTRONICS INC., Seoul (KR)

(72) Inventors: Youngjoo Shin, Seoul (KR); Chiwoo Song, Seoul (KR); Jaewon Lee, Seoul (KR); Soyoon Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 167 days.

(21) Appl. No.: 17/212,220

(22) Filed: Mar. 25, 2021

(65) Prior Publication Data

US 2021/0348797 A1 Nov. 11, 2021

(30) Foreign Application Priority Data

Mar. 30, 2020 (KR) ..... 10-2020-0037967

(51) Int. Cl.
*F25B 5/02* (2006.01)
*F25B 25/00* (2006.01)
(Continued)

(52) U.S. Cl.
CPC ..... *F24F 11/84* (2018.01); *F24F 1/0068* (2019.02)

(58) Field of Classification Search
CPC .... F24F 1/0003; F24F 1/0007; F24F 1/00077; F24F 1/06; F24F 11/83; F24F 11/84; F24F 11/86; F25B 5/02; F25B 25/005
See application file for complete search history.

(56) References Cited

U.S. PATENT DOCUMENTS 5,086,624 A * 2/1992 Matsuoka ..... F25B 13/00 62/228.3
5,247,806 A * 9/1993 Ebisu ..... F25B 49/022 236/78 D
(Continued)

FOREIGN PATENT DOCUMENTS

CN 102109246 6/2011
CN 102422093 4/2012
(Continued)

OTHER PUBLICATIONS

German Office Action issued in Application No. 102021203155.2 dated Nov. 12, 2021.
(Continued)

*Primary Examiner* — Frantz F Jules
*Assistant Examiner* — Jason N Thompson
(74) *Attorney, Agent, or Firm* — KED & ASSOCIATES

(57) ABSTRACT

A heat pump and a method for operating a heat pump are provided. The heat pump may include an outdoor unit including a compressor that compresses a refrigerant and an outdoor heat exchanger that exchanges heat between the refrigerant and outdoor air, a hybrid unit including at least one fluid-refrigerant heat exchanger that exchanges heat between the refrigerant supplied from the outdoor unit and a fluid, such as water, and at least one refrigerant control valve that controls an amount of refrigerant flowing through the at least one fluid-refrigerant heat exchanger, a plurality of indoor units each including an indoor heat exchanger that exchanges heat between the fluid supplied from the hybrid unit and indoor air, and a controller. The controller may calculate operation loads of the plurality of indoor units and control an opening degree of the at least one refrigerant control value based on the operation loads of the plurality of indoor units.

16 Claims, 12 Drawing Sheets

(51) Int. Cl.

| | |
|---|---|
| ***F24F 1/0003*** | (2019.01) |
| ***F24F 1/0007*** | (2019.01) |
| ***F24F 1/06*** | (2011.01) |
| ***F24F 11/83*** | (2018.01) |
| ***F24F 11/84*** | (2018.01) |
| ***F24F 1/0068*** | (2019.01) |

(56) References Cited

U.S. PATENT DOCUMENTS

| | | | | |
|---|---|---|---|---|
| 5,600,962 | A * | 2/1997 | Aizawa | F25B 41/35 62/204 |
| 2011/0225998 | A1* | 9/2011 | Yamashita | F25B 13/00 62/238.7 |
| 2012/0031130 | A1* | 2/2012 | Morimoto | F25B 41/40 62/196.1 |
| 2012/0031605 | A1* | 2/2012 | Takayama | F24F 11/83 165/201 |
| 2014/0026603 | A1* | 1/2014 | Toya | F24F 3/065 62/129 |
| 2014/0150483 | A1* | 6/2014 | Takayama | F25B 13/00 62/160 |
| 2014/0260385 | A1* | 9/2014 | Umeda | F25B 49/022 62/178 |

FOREIGN PATENT DOCUMENTS

| | | |
|---|---|---|
| CN | 107270570 | 10/2017 |
| EP | 2584291 | 4/2013 |
| JP | 2014-145522 | 8/2014 |
| JP | 2016-095130 | 5/2016 |
| KR | 10-2010-0046694 | 5/2010 |
| KR | 10-2019-0005052 | 1/2019 |

OTHER PUBLICATIONS

Chinese Office Action dated Jun. 10, 2022 issued in Application No. 202110334777.1.

* cited by examiner

HEAT PUMP AND METHOD FOR OPERATING HEAT PUMP

CROSS-REFERENCE TO RELATED APPLICATION(S)

This application claims the priority benefit of Korean Patent Application No. 10-2020-0037967, filed in Korea on Mar. 30, 2020 in the Korean Intellectual Property Office, the disclosure of which is incorporated herein by reference.

BACKGROUND

1. Field

A heat pump and a method for operating a heat pump are disclosed herein.

2. Background

Heat pumps refer to devices that transmit thermal energy from a low-temperature heat source to a high-temperature space or transmit thermal energy from a high-temperature heat source to a low-temperature space using evaporation heat or condensation heat of a refrigerant, and generally includes an outdoor unit including a compressor and an outdoor heat exchanger, and an indoor unit including an indoor heat exchanger. In addition, the heat pump may heat a fluid, such as water through heat exchange of refrigerant to be used for increasing the indoor temperature or supplying hot water to a user, which makes it possible to replace the use of fossil fuels.

In the case of the heat pump in the related art, water heat-exchanged with refrigerant is supplied to a heating device or a hot water supply device, and the refrigerant itself discharged from the outdoor unit is supplied to the indoor unit. That is, in the heat pump in the related art, during a cooling operation, liquid refrigerant is supplied from the outdoor unit to the indoor unit, and during a heating operation, high-temperature, high-pressure gaseous refrigerant is supplied from the outdoor unit to the indoor unit, and heat exchange between the refrigerant and indoor air is performed in a heat exchanger of the indoor unit.

Further, as disclosed in Korean Patent Laid-Open Publication No. 10-2019-0005052 (hereinafter "Patent Document 1"), which is hereby incorporated by reference, when the heat pump includes a plurality of indoor units and the plurality of indoor units cool and heat a plurality of indoor spaces, respectively, a valve that controls a flow rate of the refrigerant is individually provided in each of the plurality of indoor units, and an opening degree of the valve is independently controlled depending on an operation state of each indoor unit. However, when the refrigerant is supplied to the indoor unit as in the related art, for some reason, for example, as the liquid refrigerant and the gaseous refrigerant may be mixed while passing through an electronic expansion valve (EEV) provided in the indoor unit, vibration of a pipe through which the refrigerant flows may be generated, which in turn may cause noise indoors.

Furthermore, among eco-friendly refrigerants for replacing refrigerants with high ozone depletion potential (ODP) and global warming potential (GWP), such as Freon gas, a refrigerant containing propane or isobutane as a main component is highly flammable, and thus, when the refrigerant leaks into the indoor space, there is also a problem that there is a high possibility of fire.

BRIEF DESCRIPTION OF THE DRAWINGS

Embodiments will be described in detail with reference to the following drawings in which like reference numerals refer to like elements, and wherein.

DETAILED DESCRIPTION

Figure 1:
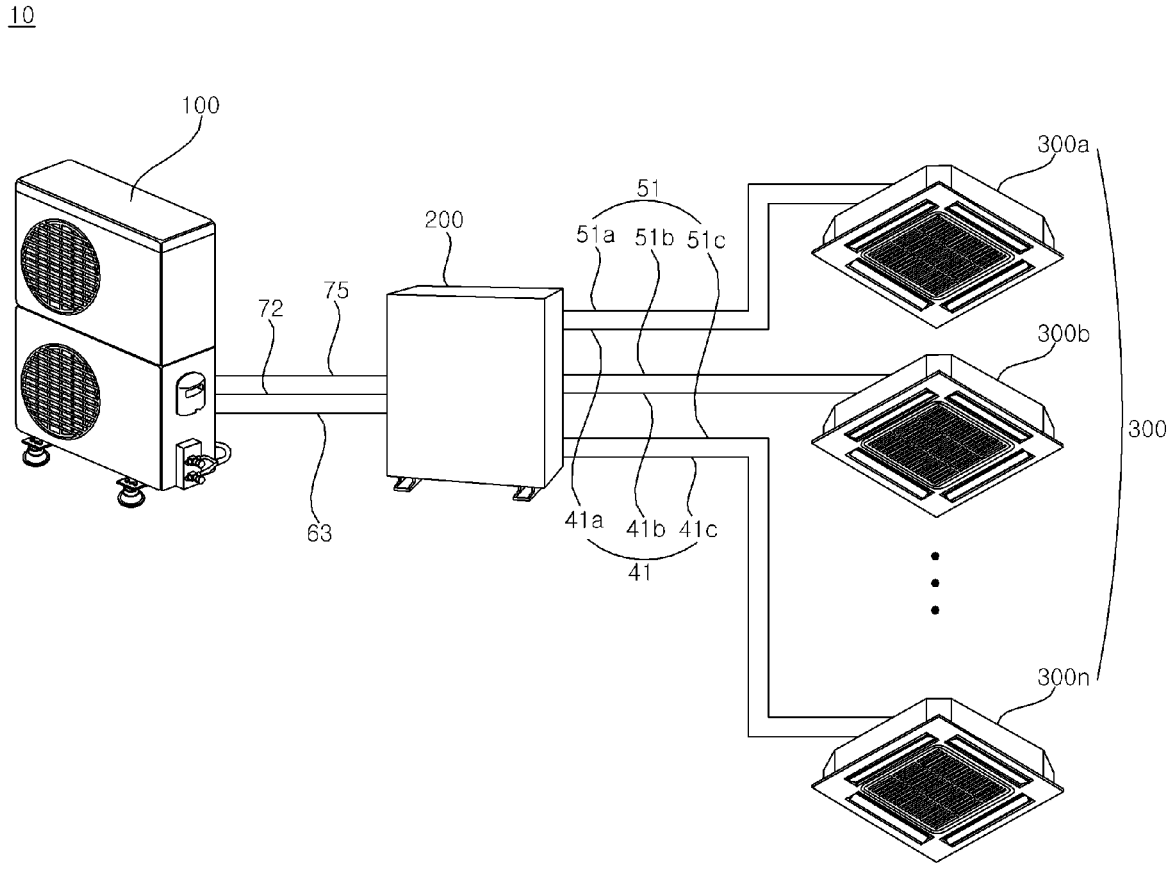
FIG. 1 is a schematic diagram of a heat pump according to an embodiment.

Advantages and features of embodiments, and a method for achieving them will be apparent with reference to embodiments described hereinafter together with the accompanying drawings. However, the embodiments are not limited to the embodiments disclosed hereinafter, but may be implemented in a variety of different forms, the embodiments are provided to only complete disclosure, and to allow a person of ordinary skill in the technical field to which the embodiments belongs to understand the scope, and the embodiments are only defined by the scope of the claims. The same reference numerals will be used to refer to the same or similar elements throughout.

Spatially relative terms such as "below", "beneath", "lower", "above", "upper", or the like, can be used to easily describe the correlation between one component and another component, as shown in the drawing. Spatially relative terms should be understood as terms including different directions of components in use or operation in addition to the direction shown in the drawings. For example, when inverting elements shown in a drawing, an element described as "below" or "beneath" of another element will be placed "above" the other element. Accordingly, the exemplary term "below" may encompass both directions below and above. An element may be oriented in other directions as well, and thus spatially relative terms may be interpreted according to the orientation.

The terms used hereinafter are used to describe embodiments and are not intended to limit embodiments. Hereinafter, the terms of a singular form may include plurals form unless otherwise specified. As used, the terms "comprises" and/or "comprising" specify the presence of stated components, steps, and/or operations, but do not exclude the presence or addition of one or more other components, steps and/or operations.

Unless otherwise defined, all terms (including technical and scientific terms) used are intended to have the meanings commonly understood by those of ordinary skill in the art to which the embodiments belongs. In addition, terms such as those defined in commonly used dictionaries should not be interpreted in an idealized or overly formal sense unless expressly defined otherwise.

In the drawings, the thickness or size of each element is exaggerated, omitted, or schematically illustrated for convenience and clarity of description. Furthermore, the size and area of each element do not fully reflect the actual size or area.

It is to be noted that the suffixes of elements used in the following description, such as a "module" and a "unit", are assigned or interchangeable with each other by taking into consideration only the ease of writing this specification, but in themselves are not particularly given distinct meanings and roles.

In this case, it will be appreciated that each block of the process flowchart drawings and combinations of the flowchart drawings may be executed by computer program instructions. As the computer program instructions may be installed on the processor of a general-purpose computer, special purpose computer or other programmable data processing equipment, the instructions executed by the processor of the computer or other programmable data processing equipment generates means for performing the functions described in the flowchart block(s). The computer program instructions can also be stored in a computer-usable or computer-readable memory that can direct a computer or other programmable data processing equipment to implement a function in a particular manner, and thus the instructions stored in the computer-usable or computer-readable memory can produce an article of manufacture containing instruction means for performing the functions described in the flowchart block(s). The computer program instructions can also be installed on a computer or other programmable data processing equipment to cause the computer or the other programmable data processing equipment to execute a series of operational steps on the computer or the other programmable data processing equipment to create a computer-executable process, and thus the instructions for operating the computer or other programmable data processing equipment can provide steps for performing the functions described in the flowchart block(s).

Furthermore, each block may represent a portion of a module, a segment, or a code, which includes one or more executable instructions for performing a specified logical function(s). It should also be noted that in some alternative implementations, the functions noted in the blocks may occur out of order. For example, two blocks shown in succession may in fact be performed substantially concurrently or the blocks may sometimes be performed in the reverse order, depending on the functionality involved.

In addition, terms such as first and second may be used to describe various elements, but these elements are not limited by these terms. These terms are only used to distinguish one element from another.

FIG. 1 is a schematic diagram of a heat pump according to an embodiment. Referring to FIG. 1, a heat pump 10 may include an outdoor unit 100, a hybrid unit 200, and/or an indoor unit 300.

The outdoor unit 100 may compress a refrigerant. The outdoor unit 100 may compress a refrigerant to discharge a high-temperature and high-pressure gaseous refrigerant, or may discharge a liquid refrigerant.

The outdoor unit 100 may be connected to the hybrid unit 200 through a plurality of pipes 63, 72, and 75. For example, the outdoor unit 100 may supply high-temperature, high-pressure gaseous refrigerant to the hybrid unit 200 through high-pressure gas pipe 63, and may receive low-pressure gaseous refrigerant from the hybrid unit 200 through low-pressure gas pipe 75. For example, the outdoor unit 100 may supply liquid refrigerant to the hybrid unit 200 through liquid pipe 72 or may receive it from the hybrid unit 200.

The hybrid unit 200 may operate to cause heat exchange between the refrigerant supplied from the outdoor unit 100 and a fluid, such as water supplied from the indoor unit 300. For example, the hybrid unit 200 may increase the temperature of the fluid supplied from the indoor unit 300 using high-temperature, high-pressure refrigerant supplied from the outdoor unit 100, and transfer hot fluid to the indoor unit 300. For example, the hybrid unit 200 may decrease the temperature of the fluid supplied from the indoor unit 300 using liquid refrigerant supplied from the outdoor unit 100, and transfer cold fluid to the indoor unit 300.

The indoor unit 300 may be connected to the hybrid unit 200 through a plurality of pipes 41 and 51. For example, the indoor unit 300 may receive fluid from the hybrid unit 200 through an inlet pipe 41, and may transfer fluid to the hybrid unit 200 through a discharge pipe 51.

The indoor unit 300 may operate to cause heat exchange between fluid supplied from the hybrid unit 200 and indoor air. For example, when hot fluid is supplied from the hybrid unit 200, the indoor unit 300 may provide a heating function by discharging air heat-exchanged with the hot fluid. For example, when cold fluid is supplied from the hybrid unit 200, the indoor unit 300 may provide a cooling function by discharging air heat-exchanged with the cold fluid.

In the drawing, the indoor unit 300 is illustrated as a ceiling type indoor unit; however, embodiments are not limited thereto, and various types of indoor units, such as a stand type, a wall-mounted type, and a ceiling type are applicable.

The heat pump 10 may include a plurality of indoor units 300*a* to 300*n*, and the plurality of indoor units 300*a* to 300*n* may be connected to the hybrid unit 200. In the drawing, the hybrid unit 200 and the plurality of indoor units 300*a* to 300*n* are illustrated as being connected through separate pipes; however, embodiments are not limited thereto, and a pipe connected to the hybrid unit 200 may be branched and connected to each of the plurality of indoor units 300*a* to 300*n*.

The outdoor unit 100, the hybrid unit 200, and/or the indoor unit 300 may be connected by a communication line to transmit and receive data to one another, and may be connected to a central controller (not shown) by wire or wirelessly to be operated under the control of the central controller.

The indoor unit 300 may be connected to a remote controller (not shown), and may receive a user's control command through the remote controller. For example, the user may use the remote controller to control power on/off of the indoor unit 300 and to change an operation mode or a set temperature of the indoor unit 300. In this case, the indoor unit 300 may communicate with the remote controller by wire or wirelessly based on the connection type.

Figure 2:
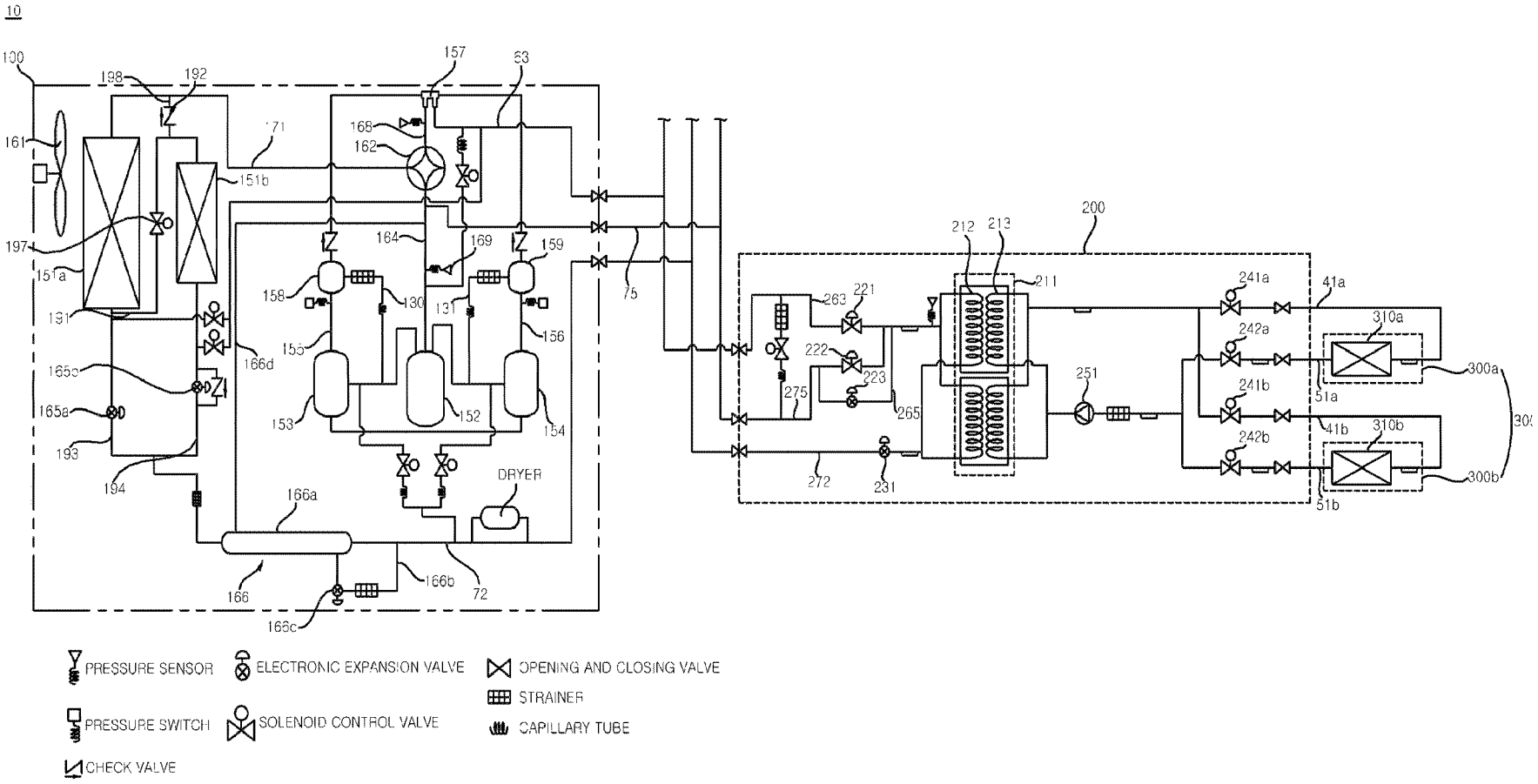
FIG. 2 is a schematic diagram of an outdoor unit, a hybrid unit, and an indoor unit according to an embodiment.

FIG. 2 is a schematic diagram of the outdoor unit, the hybrid unit, and the indoor unit of FIG. 1 according to an embodiment. Referring to FIG. 2, the outdoor unit 100 may include compressors 153 and 154 that compress the refrigerant, outdoor heat exchangers 151*a* and 151*b* that dissipate the compressed refrigerant, an accumulator 152 that temporarily stores the gasified refrigerant to remove moisture and foreign matter, and then supplies refrigerant having a constant pressure to the compressors 153 and 154, a cooling/heating switching valve 162 that switches flow paths of the compressed refrigerant, oil separators 158 and 159, an outdoor fan 161 disposed on one side of the outdoor heat exchangers 151*a* and 151*b* to promote heat dissipation of the refrigerant, and at least one expansion mechanism, for example, an electronic expansion valve (EV)) that expands the condensed refrigerant.

The compressors 153 and 154 may include at least one of an inverter compressor or a constant speed compressor. For example, first compressor 153 may be an inverter compressor capable of varying a compression capacity of the refrigerant, and second compressor 154 may be a constant speed compressor having a constant compression capacity of the refrigerant.

Discharge units of the compressors 153 and 154 may be connected to first and second discharge pipes 155 and 156, respectively, and the first and second discharge pipes 155 and 156 may be connected to a branch joint 157. The oil separators 158 and 159 that recover oil from the refrigerant discharged from the compressors 155 and 154 may be provided in the first and second discharge pipes 155 and 156, respectively, and the oil separators 158 and 159 may be connected to the oil recovery pipes 130 and 131 that guide the oil separated by the oil separators 158 and 159 to the compressors 153 and 154, respectively.

A suction pipe 164 may be connected to the accumulator 151, and a suction pressure sensor 169 may be disposed at the suction pipe 164. The suction pressure sensor 169 may sense a suction pressure of the refrigerant flowing into the compressors 153 and 154, and a suction pressure value may be transmitted to a controller (550 in FIG. 5).

The branch joint 157 may be connected to the high-pressure gas pipe 63 through which the refrigerant discharged from the compressors 153 and 154 may be bypassed without passing through four-way valve 162. The branch joint 157 may be connected to the four-way valve 162 through a third discharge pipe 168.

The outdoor heat exchangers 151*a* and 151*b* may exchange heat between outdoor air and refrigerant. The outdoor heat exchangers 151*a* and 151*b* may operate as a condenser during a cooling operation and as an evaporator during a heating operation.

The outdoor heat exchangers 151*a* and 151*b* may be connected to the four-way valve 162 by a first connection pipe 171. In order to facilitate heat exchange in the outdoor heat exchangers 151*a* and 151*b*, the outdoor fan 161 may be disposed on one side of the outdoor heat exchangers 151*a* and 151*b*.

First outdoor heat exchanger 151*a* may be connected to a first bypass pipe 191 and a first distribution pipe 193. The first connection pipe 171 and a first bypass pipe 191 may be connected by a second bypass pipe 198. Second outdoor heat exchanger 151*b* may be connected to the first bypass pipe 191 and a second distribution pipe 194 that joins the first distribution pipe 193.

One or a first end of the first connection pipe 171 may be connected to the four-way valve 162, and the other or a second end of the first connection pipe 171 may be connected to the first heat exchanger 151*a* and the second bypass pipe 198. In the first distribution pipe 193, a first outdoor expansion valve 165*a* that controls an opening degree of the first distribution pipe 193 may be disposed. For example, under the control of the controller 551, the first outdoor expansion valve 165*a* may throttle, bypass, or block the refrigerant passing through the first distribution pipe 193.

In the first bypass pipe 191, a first on/off valve 197 that is opened and closed to control the flow of the refrigerant may be disposed. For example, when the first on/off valve 197 is opened, the refrigerant may be transferred from the first outdoor heat exchanger 151*a* to the second outdoor heat exchanger 151*b*. In the drawing, the first bypass pipe 191 is illustrated as being branched from the first distribution pipe 193 and being connected to the second outdoor heat exchanger 151*b*; however, embodiments are not limited thereto.

In the second bypass pipe 198, a first check valve 192 may be disposed. The first check valve 192 may prevent the refrigerant from flowing from the first connection pipe 171 to the first bypass pipe 191.

In the second distribution pipe 194, a second outdoor expansion valve 165*b* that controls an opening degree of the second distribution pipe 194 may be disposed. For example, under the control of the controller 551, the second outdoor expansion valve 165*b* may throttle, bypass, or block the refrigerant passing through the second distribution pipe 194.

A supercooling device 166 may cool the refrigerant transferred to the hybrid unit 200. The supercooling device 166 may include a supercooling heat exchanger 166*a*, a supercooling bypass pipe 166*b* bypassed from the liquid pipe 72 and connected to the supercooling heat exchanger 166*a*, a supercooling expansion valve 166*c* disposed in the supercooling bypass pipe 166*b* and selectively expanding the refrigerant, and/or a recovery pipe 166*d* that connects the supercooling heat exchanger 166*a* to the third discharge pipe 168.

The hybrid unit 200 may include a fluid-refrigerant heat exchanger 211 for exchange heat between a fluid, such as water and the refrigerant supplied from the outdoor unit 100. The fluid-refrigerant heat exchanger 211 may be a double tube heat exchanger in which a refrigerant flow path 212 through which a refrigerant flows and a fluid flow path 213 through which a fluid, such as water flows are formed inside/outside with a heat transfer member interposed therebetween, or may be a plate heat exchanger in which the refrigerant flow path 212 and the fluid flow path 213 are alternately formed with the heat transfer member interposed therebetween. Hereinafter, a case where the fluid-refrigerant heat exchanger 211 is a plate heat exchanger will be described as an example.

The refrigerant flow path 212 of the fluid-refrigerant heat exchanger 211 may be connected to a high-pressure gaseous refrigerant flow path 263 through which a high-temperature, high-pressure gaseous refrigerant flows, a low-pressure gaseous refrigerant flow path 275 through which a low-pressure gaseous refrigerant flows, and/or a liquid refrigerant flow path 272 through which a liquid refrigerant flows.

The hybrid unit 200 may include a high-pressure gas valve 221 disposed in the high-pressure gaseous refrigerant flow path 263 and controlling an opening degree of the high-pressure gaseous refrigerant flow path 263. For example, when the operation mode of the indoor unit 300 connected to the fluid-refrigerant heat exchanger 211 is a heating mode, the high-pressure gas valve 221 is turned on and the refrigerant flowing through the high-pressure gaseous refrigerant flow path 263 may be transferred to the refrigerant flow path 212.

The hybrid unit 200 may include a low-pressure gas valve 222 disposed in the low-pressure gaseous refrigerant flow path 275 and controlling an opening degree of the low-pressure gaseous refrigerant flow path 275. For example, when the operation mode of the indoor unit 300 connected to the fluid-refrigerant heat exchanger 211 is a cooling mode, the low-pressure gaseous refrigerant flow path 275 is opened and the refrigerant discharged from the refrigerant flow path 212 may flow to the low-pressure gaseous refrigerant flow path 275.

The hybrid unit 200 may include a refrigerant control valve 231 disposed in the liquid refrigerant flow path 272 and controlling an amount of refrigerant flowing through the refrigerant flow path 212. The refrigerant control valve 231 may be an electronic expansion valve (EEV), for example, and an opening degree may be controlled according to an input pulse value. For example, when the pulse input to the refrigerant control valve 231 decreases by 50%, the opening degree of the refrigerant control valve 231 may also be decreased by 50%.

The hybrid unit 200 may further include a flat pressure valve 223 that operates so that an internal pressure of the fluid-refrigerant heat exchanger 211 achieves a flat pressure. The hybrid unit 200 may further include a pump 251 that pumps fluid circulating through the fluid flow path 213. For example, the pump 251 may be disposed in a pipe through which fluid supplied from the indoor unit 300 flows and may operate so that fluid discharged from the indoor unit 300 flows to the fluid-refrigerant heat exchanger 211.

The hybrid unit 200 may include supply valves 241*a* and 241*b* disposed in inlet pipes 41*a* and 41*b* through which fluid supplied to each of the plurality of indoor units 300 flows, and control an opening degree of the inlet pipes 41*a* and 41*b*. The hybrid unit 200 may include discharge valves 242*a* and 242*b* disposed in discharge pipes 51*a* and 51*b* through which fluid supplied from each of the plurality of indoor units 300 flows, and control an opening degree of the discharge pipes 51*a* and 51*b*.

In the drawing, the supply valves 241*a* and 241*b* and the discharge valves 242*a* and 242*b* are illustrated as being provided in the hybrid unit 200; however, embodiments are not limited thereto, and they may be provided in the indoor unit 300, or may be separately disposed between the hybrid unit 200 and the indoor unit 300. On the other hand, according to another embodiment, any one of the supply valves 241*a* and 241*b* and the discharge valves 242*a* and 242*b* may be omitted.

The indoor units 300*a* and 300*b* may include indoor heat exchangers 310*a* and 310*b*, an indoor fan (not shown), and a plurality of sensors (not shown). The indoor heat exchangers 310*a* and 310*b* may exchange heat between cold fluid or hot fluid supplied from the hybrid unit 200 and air. The indoor fan may discharge air heat-exchanged by the indoor heat exchangers 310*a* and 310*b* indoors through rotation.

Figure 3:
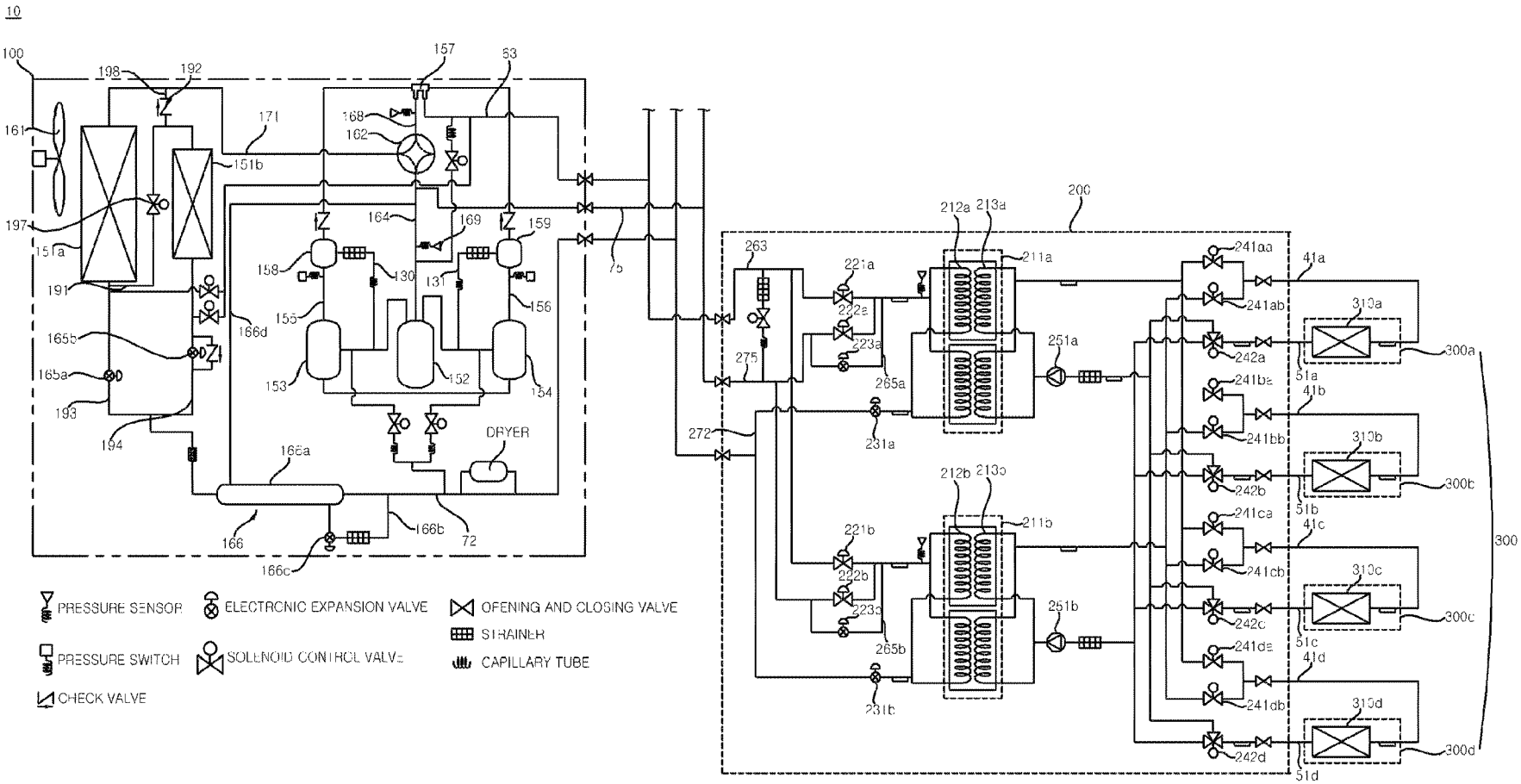
FIG. 3 is a schematic diagram of an outdoor unit, a hybrid unit, and an indoor unit according to another embodiment.

FIG. 3 is a schematic diagram of the outdoor unit, the hybrid unit, and the indoor unit of FIG. 1 according to another embodiment. Description of the same components as those described in FIG. 2 has been omitted.

Referring to FIG. 3, the hybrid unit 200 may include a plurality of fluid-refrigerant heat exchangers 211*a* and 211*b*. In the drawing, the hybrid unit 200 is shown to include two fluid-refrigerant heat exchangers 211*a* and 211*b*; however, embodiments are not limited thereto, and three or more may be provided.

The hybrid unit 200 may include a plurality of high-pressure gas valves 221*a* and 221*b*, low-pressure gas valves 222*a* and 222*b*, flat pressure valves 223*a* and 223*b*, refrigerant control valves 231*a* and 231*b*, and/or pumps 251*a* and 251*b*, respectively, corresponding to the number of a plurality of fluid-refrigerant heat exchangers 211*a* and 211*b*. Further, the hybrid unit 200 may include a plurality of supply valves 241*aa* to 241*db* and discharge valves 242*a* to 242*d*, respectively, corresponding to the number of the plurality of fluid-refrigerant heat exchangers 211*a* and 211*b* and the plurality of indoor units 300. In the drawing, the discharge valves 242*a* to 242*d* are illustrated as being three-way valves; however, embodiments are not limited thereto.

The plurality of indoor units 300 may be connected to the plurality of fluid-refrigerant heat exchangers 211*a* and 211*b*, respectively, through inlet pipes 41*a* to 41*d* and discharge pipes 51*a* to 51*d*, and may receive fluid from any one of the plurality of fluid-refrigerant heat exchangers 211*a* and 211*b* according to the operation mode. In this regard, a description will be given with reference to FIGS. 4A to 4C.

Figure 4A:
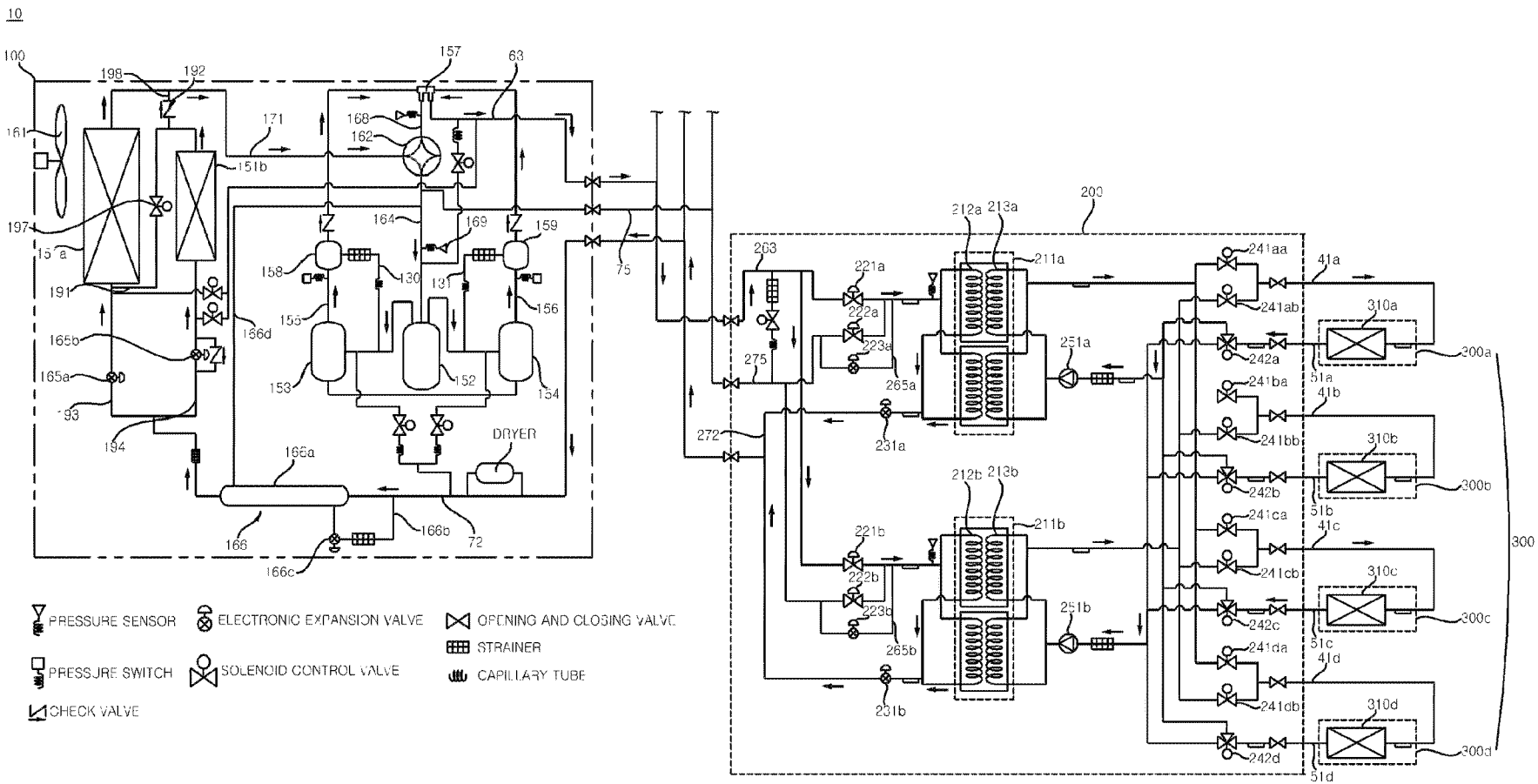
FIGS. 4A to 4C are diagrams illustrating an operation state of a heat pump depending on an operation state of a plurality of indoor units.
Figure 4B:
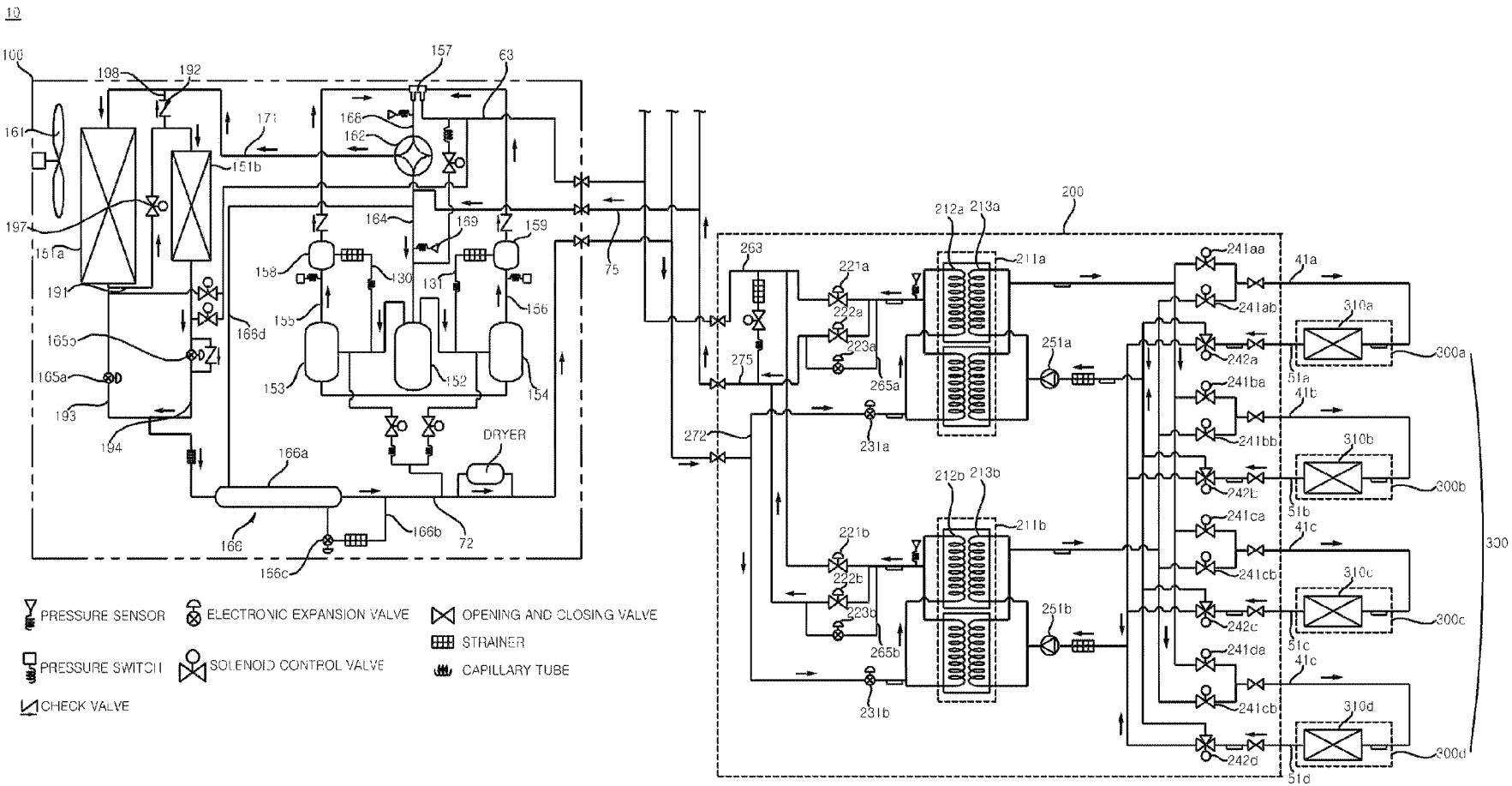
Figure 4C:
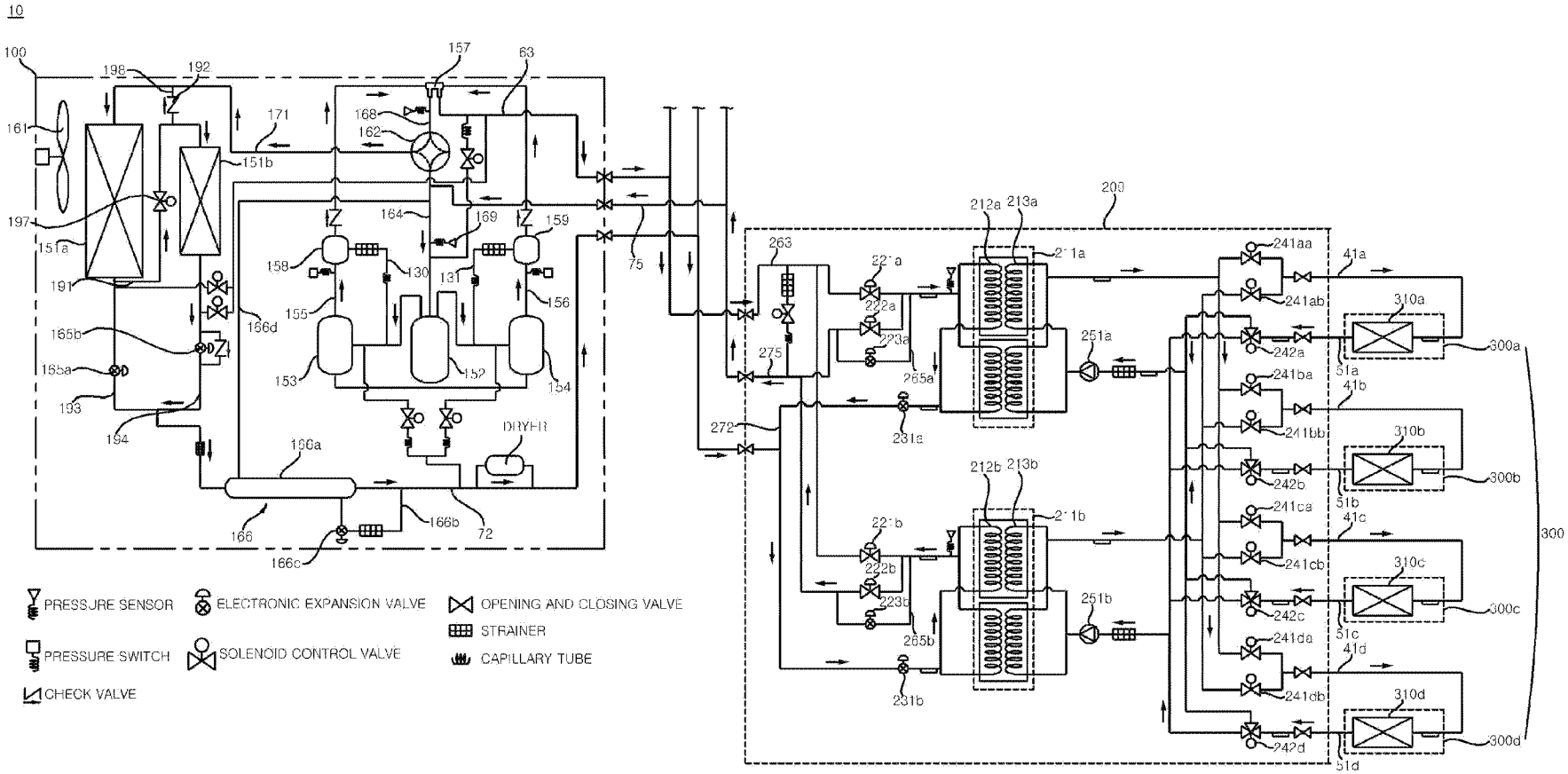

FIGS. 4A to 4C are diagrams illustrating an operation state of a heat pump depending on an operation state of a plurality of indoor units. FIG. 4A illustrates an operation state of each component when, among the plurality of indoor units 300, the operation modes of first and third indoor units 300*a* and 300*c* are set to a heating mode and second and fourth indoor units 300*b* and 300*d* are powered off and the operation mode of the heat pump 10 is set to the heating mode.

Referring to FIG. 4A, in the heat pump 10, the indoor unit 300 connected to each of the plurality of fluid-refrigerant heat exchangers 211*a* and 211*b* may be determined, in consideration of operation loads of the plurality of indoor units 300. For example, when only the first and third indoor units 300*a* and 300*c* are powered on among the plurality of indoor units 300, the first indoor unit 300*a* may be connected to the first fluid-refrigerant heat exchanger 211*a*, and the second indoor unit 300*b* may be connected to the second fluid-refrigerant heat exchanger 211*b*. In addition, depending on a connection relationship between the plurality of fluid-refrigerant heat exchangers 211*a* and 211*b* and the plurality of indoor units 300, opening and closing of the supply valves 241*aa* to 241*db* and the discharge valves 242*a* to 242*d* may be determined.

When the operation mode of the heat pump 10 is set to the heating mode, the high-temperature, high-pressure gaseous refrigerant compressed and discharged by the compressors 153 and 154 may flow to the high-pressure gas pipe 63 through the first and second discharge pipes 155 and 156 and the branch joint 157, and may be supplied to the hybrid unit 200 through the high-pressure gas pipe 63. In addition, by opening the high-pressure gas valves 221*a* and 221*b* of the hybrid unit 200, the high-temperature, high-pressure gaseous refrigerant supplied from the outdoor unit 100 may be transferred to refrigerant flow paths 212*a* and 212*b* of the plurality of fluid-refrigerant heat exchangers 211*a* and 211*b*.

The plurality of fluid-refrigerant heat exchangers 211*a* and 211*b* may exchange heat between the high-temperature, high-pressure gaseous refrigerant flowing in the refrigerant flow paths 212*a* and 212*b* and the fluid flowing in fluid flow paths 213*a* and 213*b*. In this case, the liquid refrigerant may be discharged from the refrigerant flow paths 212*a* and 212*b* to flow to the liquid refrigerant flow path 272 by heat exchange in the plurality of fluid-refrigerant heat exchangers 211*a* and 211*b*.

The liquid refrigerant flowing in the liquid refrigerant flow path 272 may be supplied to the outdoor unit 100 through the liquid pipe 72. The liquid refrigerant supplied to the outdoor unit 100 may be transferred to the outdoor heat exchangers 151*a* and 151*b*, and the outdoor heat exchangers 151*a* and 151*b* may exchange heat between the liquid refrigerant and outdoor air. In this case, by heat exchange in the outdoor heat exchangers 151*a* and 151*b*, low-pressure gaseous refrigerant may be discharged from the outdoor heat exchangers 151*a* and 151*b* to the first connection pipe 171, and the low-pressure gaseous refrigerant may be transferred to the compressors 153 and 154 through the accumulator 152.

The high-temperature fluid heat-exchanged with the high-temperature, high-pressure gaseous refrigerant may be supplied to the first and third indoor units 300*a* and 300*c*, and may be heat-exchanged with indoor air in indoor heat exchangers 310*a* and 310*c* of the first and third indoor units 300*a* and 300*c*. In this case, the air heat-exchanged in the indoor heat exchangers 310*a* and 310*c* may be discharged indoors by rotation of indoor fans provided in the first and third indoor units 300*a* and 300*c*.

FIG. 4B illustrates an operation state of each component when all the operation modes of the plurality of indoor units 300 are set to a cooling mode and the operation mode of the heat pump 10 is set to the cooling mode. Referring to FIG. 4B, in the heat pump 10, the indoor unit 300 connected to each of the plurality of fluid-refrigerant heat exchangers 211*a* and 211*b* may be determined, in consideration of operation loads of the plurality of indoor units 300. For example, among the plurality of indoor units 300, the first indoor unit 300*a* and the second indoor unit 300*b* may be connected to the first fluid-refrigerant heat exchanger 211*a*, and the third indoor unit 300*c* and the fourth indoor unit 300*d* may be connected to the second fluid-refrigerant heat exchanger 211*b*. In addition, depending on the connection relationship between the plurality of fluid-refrigerant heat exchangers 211*a* and 211*b* and the plurality of indoor units 300, opening and closing of the supply valves 241*aa* to 241*db* and the discharge valves 242*a* to 242*d* may be determined.

When the operation mode of the heat pump 10 is set to the cooling mode, the high-temperature, high-pressure gaseous refrigerant compressed and discharged by the compressors 153 and 154 may flow to the first connection pipe 171 through the first and second discharge pipes 155 and 156, the branch joint 157, and the cooling/heating switching valve 162, and may be transferred to the outdoor heat exchangers 151*a* and 151*b* through the first connection pipe 171. The outdoor heat exchangers 151*a* and 151*b* may exchange heat between the high-temperature, high-pressure gas and outdoor air. In this case, by heat exchange in the outdoor heat exchangers 151*a* and 151*b*, the liquid refrigerant may be discharged to the second distribution pipe 194 to flow to the liquid pipe 72.

The liquid refrigerant flowing in the liquid pipe 72 may be supplied to the hybrid unit 200, and the liquid refrigerant supplied to the hybrid unit 200 may be transferred to the refrigerant flow paths 212*a* and 212*b* of 211*a* and 211*b* of the plurality of fluid-refrigerant heat exchangers 211*a* and 211*b* through the liquid refrigerant flow path 272.

The plurality of fluid-refrigerant heat exchangers 211*a* and 211*b* may exchange heat between the liquid refrigerant flowing in the refrigerant flow paths 212*a* and 212*b* and the fluid flowing in the fluid flow paths 213*a* and 213*b*. In this case, the low-pressure gaseous refrigerant may be discharged from the refrigerant flow paths 212*a* and 212*b* to flow to the low-pressure gaseous refrigerant flow path 275 by heat exchange in the plurality of fluid-refrigerant heat exchangers 211*a* and 211*b*.

The low-pressure gaseous refrigerant flowing in the low-pressure gaseous refrigerant flow path 275 may be supplied to the outdoor unit 100 through the low-pressure gas pipe 75. The low-pressure gaseous refrigerant supplied to the outdoor unit 100 may be transferred to the compressors 153 and 154 through the accumulator 152.

The low-temperature fluid heat-exchanged with the liquid refrigerant may be supplied to the plurality of indoor units 300*a* to 300*d*, and may be heat-exchanged with indoor air in indoor heat exchangers 310*a* to 310*d* of the plurality of indoor units 300*a* to 300*d*. In this case, the air heat-exchanged in the indoor heat exchangers 310*a* to 310*d* may be discharged indoors by rotation of indoor fans provided in the plurality of indoor units 300*a* to 300*d*.

FIG. 4C illustrates an operation state of each component when some operation modes of the plurality of indoor units 300 are set to the cooling mode, some other operation modes thereof are set to the cooling mode, and the operation mode of the heat pump 10 is set to a cooling/heating mode.

Referring to FIG. 4C, in the heat pump 10, the indoor unit 300 connected to each of the plurality of fluid-refrigerant heat exchangers 211*a* and 211*b* may be determined, in consideration of the operation modes of the plurality of indoor units 300. For example, among the plurality of indoor units 300, the first indoor unit 300*a* and the third indoor unit 300*c* set to the heating mode may be connected to the first fluid-refrigerant heat exchanger 211*a*, and the fourth indoor unit 300*d* set to the cooling mode may be connected to the second fluid-refrigerant heat exchanger 211*b*. In addition, depending on the connection relationship between the plurality of fluid-refrigerant heat exchangers 211*a* and 211*b* and the plurality of indoor units 300, opening and closing of the supply valves 241*aa* to 241*db* and the discharge valves 242*a* to 242*d* may be determined.

When the operation mode of the heat pump 10 is set to the cooling/heating mode, the high-temperature, high-pressure gaseous refrigerant compressed and discharged by the compressors 153 and 154 may flow to the branch joint 157 through the first and second discharge pipes 155 and 156. In this case, at least some of the high-temperature, high-pressure gaseous refrigerant transferred to the branch joint 157 may flow through the high-pressure gas pipe 63, and some of the remaining high-temperature, high-pressure gaseous refrigerant which is not transferred to the high-pressure gas pipe 63 may flow to the first connection pipe 171 through the cooling/heating switching valve 162.

The high-temperature, high-pressure gaseous refrigerant flowing in the first connection pipe 171 may be transferred to the outdoor heat exchangers 151*a* and 151*b*, and may be heat-exchanged with outdoor air in the outdoor heat exchangers 151*a* and 151*b*. In this case, by heat exchange in the outdoor heat exchangers 151*a* and 151*b*, the liquid refrigerant may be discharged to the second distribution pipe 194 to flow to the liquid pipe 72.

The high-pressure gas valve 221*a* of the hybrid unit 200 may be opened and the second high-pressure gas valve 221*b* closed, and the high-temperature, high-pressure gaseous refrigerant supplied from the outdoor unit 100 through the high-pressure gas pipe 63 may be transferred to the refrigerant flow path 212*a* of the first fluid-refrigerant heat exchanger 211*a*.

The first fluid-refrigerant heat exchanger 211*a* may exchange heat between the high-temperature, high-pressure gaseous refrigerant flowing in the refrigerant flow path 212*a* and the fluid flowing in the fluid flow path 213*a*. In this case, the liquid refrigerant may be discharged from the refrigerant flow path 212*a* to flow to the liquid refrigerant flow path 272 by heat exchange in the first fluid-refrigerant heat exchanger 211*a*.

The liquid refrigerant supplied from the outdoor unit 100 through the liquid pipe 72 may be transferred to the refrigerant flow path 212*b* of the second fluid-refrigerant heat exchanger 211*b* together with the liquid refrigerant flowing in the liquid refrigerant flow path 272. The second fluid-refrigerant heat exchangers 211*b* may exchange heat between the liquid refrigerant flowing in the refrigerant flow path 212*b* and the fluid flowing in the fluid flow path 213*b*. In this case, the low-pressure gaseous refrigerant may be discharged from the refrigerant flow path 212*b* to flow to the low-pressure gaseous refrigerant flow path 275 by heat exchange in the second fluid-refrigerant heat exchanger 211*b*.

The low-pressure gaseous refrigerant flowing in the low-pressure gaseous refrigerant flow path 275 may be supplied to the outdoor unit 100 through the low-pressure gas pipe 75. The low-pressure gaseous refrigerant supplied to the outdoor unit 100 may be transferred to the compressors 153 and 154 through the accumulator 152.

The high-temperature fluid heat-exchanged in the first fluid-refrigerant heat exchanger 211*a* may be supplied to the first and third indoor units 300*a* and 300*c*. The low-temperature fluid heat-exchanged in the second fluid-refrigerant heat exchanger 211*b* may be supplied to the fourth indoor unit 300*d*.

Figure 5:
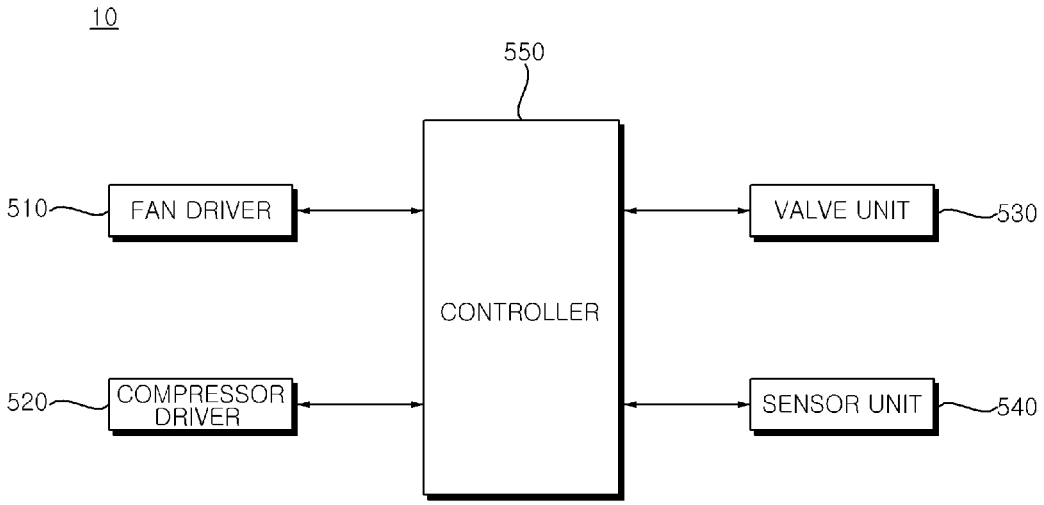
FIG. 5 is a block diagram of a heat pump according to an embodiment.

FIG. 5 is a block diagram of a heat pump according to an embodiment. Referring to FIG. 5, the heat pump 10 may include fan driver 510, compressor driver 520, valve unit 530, a sensor unit 540, and/or controller 550. The fan driver 510 may drive at least one fan provided in the heat pump 10. For example, the fan driver 510 may drive outdoor fan 161 provided in the outdoor unit 100 and/or indoor fans provided in the plurality of indoor units 300.

The fan driver 510 may include a rectifier (not shown) that rectifies and outputs alternating current (AC) power to direct current (DC) power, a DC stage capacitor that stores a ripple voltage from the rectifier, an inverter (not shown) that has a plurality of switching elements and converts a smoothed DC power into a three-phase AC power having a predetermined frequency and outputs the converted power supply, and/or a motor (not shown) that drives a fan by the three-phase AC power output from the inverter.

The compressor driver 520 may drive compressors 153 and 154. The compressor driver 520 may include a rectifier (not shown) that rectifies AC power to DC power and outputs the DC power, a DC stage capacitor (not shown), an inverter (not shown), and/or a compressor motor (not shown) that drives the compressors 153 and 154 by the three-phase AC power output from the inverter. When the outdoor unit 200 includes the plurality of compressors 153 and 154, the compressor driver 520 may include respective compressor motors, which correspond to the plurality of compressors 153 and 154, respectively.

The valve unit 530 may include various valves provided in the heat pump 10. The valves included in the valve unit 530 may operate under control of the controller 550. For example, the valve unit 530 may include cooling/heating switching valve 162, an expansion valve and an on/off valve, which are provided in the outdoor unit 200, high-pressure gas valve 221, low-pressure gas valve 222, flat pressure valve 223, and refrigerant control valve 231, which are provided in the hybrid unit 200, and the like.

The sensor unit 540 may include at least one sensor and may transmit data on a sensing value sensed through at least one sensor to the controller 550. At least one sensor provided in the sensor unit 540 may be disposed inside or outside of the outdoor unit 100, the hybrid unit 200, and/or the indoor unit 300. For example, the sensor unit 540 may include a heat exchanger temperature sensor disposed in the outdoor heat exchangers 151*a* and 151*b*, at least one pressure sensor that detects the pressure of the refrigerant flowing through each pipe, and/or at least one temperature sensor that detects the temperature of the fluid flowing through each pipe, for example.

The sensor unit 540 may include an indoor temperature sensor that detects an indoor temperature and/or an outdoor temperature sensor that detects an outdoor temperature. For example, the outdoor temperature sensor may be disposed in the outdoor unit 100, and the indoor temperature sensor may be disposed in the indoor unit 300.

The controller 550 may be connected to each component provided in the heat pump 10 and may control the overall operation of each component. The controller 550 may transmit and receive data to and from each component provided in the heat pump 10. The controller 550 may be provided not only in the outdoor unit 100, but also in a remote controller (not shown) that remotely controls operation of the hybrid unit 200, the indoor unit 300, and/or the heat pump 10, for example.

The controller 550 may include at least one processor, and may control the overall operation of the heat pump 10 using a processor included therein. The processor may be a general processor, such as a central processing unit (CPU). Of course, the processor may be a dedicated device, such as an application-specific integrated circuit (ASIC) or another hardware-based processor.

The controller 550 may control operation of the fan driver 510. For example, the controller 550 may change a frequency of the three-phase AC power output to the motor to rotate the outdoor fan 161 through operation control of the fan driver 510 to change a rotational speed of the outdoor fan 161.

The controller 550 may control operation of the compressor driver 520. For example, the controller 550 may change the frequency of the three-phase AC power output to the compressor motor to drive the compressors 153 and 154 through operation control of the compressor driver 520, to change an operating frequency of the compressors 153 and 154.

The controller 550 may control operation of at least one valve included in the valve unit 530. For example, when the operation mode of the heat pump 10 is set to one of the heating mode, the cooling mode, and the cooling/heating mode, the controller 550 may control operations of the branch joint 157, the four-way valve 162, the high-pressure gas valve 221, and/or the low-pressure gas valve 222, for example, corresponding to each mode.

The controller 550 may calculate operation loads of the plurality of indoor units 300. The controller 550 may calculate the operation loads of the plurality of indoor units 300 based on at least one of power on/off, the set temperature, the indoor temperature, the operation mode, and/or the power consumption of the plurality of indoor units 300. For example, an operation load of an indoor unit that is powered off among the plurality of indoor units 300 may be calculated as zero. For example, the operation load may be calculated based on a difference between a set temperature set for each of the plurality of indoor units 300 and the indoor temperature, and the larger the difference between the set temperature and the indoor temperature, the greater the operation load may be calculated.

The controller 550 may calculate an amount of change in a total operation load for all of the plurality of indoor units 300, based on the operation loads of the plurality of indoor units 300, and determine the operating frequency of the compressors 153 and 154 based on the amount of change in the calculated total operation load. For example, when half of the plurality of indoor units 300 get powered off while the plurality of indoor units 300 operates according to a same setting with the power on, the controller 550 may calculate the amount of change in the total operation load as −50%, and may control the compressor driver 520 such that the operating frequency of the compressors 153 and 154 are also reduced by 50% with the amount of change in the total operation load. In this case, when the amount of change in the total operation load is calculated as −50%, the controller 550 may control the compressor driver 520 such that the operating frequency of the first compressor 153 among the compressors 153 and 154 is maintained and the operation of the second compressor 154 is stopped.

When the heat pump 10 includes the plurality of fluid-refrigerant heat exchangers 211*a* and 211*b*, the controller 550 may determine a connection relationship between the plurality of fluid-refrigerant heat exchangers 211*a* and 211*b* and the plurality of indoor units 300. The controller 550 may determine the connection relationship between the plurality of fluid-refrigerant heat exchangers 211*a* and 211*b* and the plurality of indoor units 300 based on the operation loads of the plurality of indoor units 300. For example, the controller 550 may determine the connection relationship between the plurality of fluid-refrigerant heat exchangers 211*a* and 211*b* and the plurality of indoor units 300 such that the operation loads of the plurality of indoor units 300 is distributed depending on the number of the plurality of fluid-refrigerant heat exchangers 211*a* and 211*b*.

The controller 550 may determine the connection relationship between the plurality of fluid-refrigerant heat exchangers 211*a* and 211*b* and the plurality of indoor units 300 based on the operation modes of the plurality of indoor units 300. For example, the controller 550 may determine the connection relationship between the plurality of fluid-refrigerant heat exchangers 211*a* and 211*b* and the plurality of indoor units 300 such that the indoor unit set in the cooling mode is connected to the first fluid-refrigerant heat exchanger 211*a* and the indoor unit set in the heating mode is connected to the second fluid-refrigerant heat exchanger 211*b* among the plurality of indoor units 300. The controller 550 may control the opening degree of the refrigerant control valve 231 based on the operation loads of the plurality of indoor units 300.

The controller 550 may calculate the amount of change in the operation load for the indoor unit 300 connected to the fluid-refrigerant heat exchanger 211 based on the operation loads of the plurality of indoor units 300, and may determine the opening degree of the refrigerant control valve 231 based on the calculated amount of change in the operation load. For example, when the operation load of the indoor unit 300 connected to the fluid-refrigerant heat exchanger 211 is reduced from 20 kBTU (kilo British thermal unit) to 15 kBTU, the controller 550 may calculate the amount of change in the operation load as −25%, and may control the opening degree of the refrigerant control valve 231 to decrease by 25%.

In determining the opening degree of the refrigerant control valve 231, the controller 550 may set application ratios of the amount of change in the operation load to be different depending on the operation mode of the indoor unit 300 connected to the fluid-refrigerant heat exchanger 211. In this case, the application ratio may be determined in consideration of the degree of influence of the compressors 153 and 154 and the refrigerant control valve 231 on the operating efficiency in relation to the operation mode of the indoor unit 300 connected to the fluid-refrigerant heat exchanger 211.

For example, when the operation mode of the indoor unit 300 connected to the fluid-refrigerant heat exchanger 211 is the cooling mode and the amount of change in the operation load is −50%, the controller 550 may control the opening degree of the refrigerant control valve 231 to decrease by 50% by applying the calculated amount of change in the operation load by a first ratio, for example, 100%. For example, when the operation mode of the indoor unit 300 connected to the fluid-refrigerant heat exchanger 211 is the heating mode and the amount of change in the operation load is −50%, the controller 550 may control the opening degree of the refrigerant control valve 231 to decrease by 30% by applying the calculated amount of change in the operation load by a second ratio, for example, 60%. When the heat pump 10 includes the plurality of fluid-refrigerant heat exchangers 211*a* and 211*b*, the controller 550 may control the opening degrees of the refrigerant control valves 231*a* and 231*b* corresponding to the plurality of fluid-refrigerant heat exchangers 211*a* and 211*b*, respectively, based on the operation loads of the indoor units respectively connected to the plurality of fluid-refrigerant heat exchangers 211*a* and 211*b*.

The heat pump 10 may further include an output unit (not shown). The output unit may include a display device, such as a display and a light emitting diode (LED), and may display a message regarding the operation of the heat pump 10 through the display device. The output unit may include an audio device, such as a speaker or a buzzer, and may output a warning sound through the audio device.

Figure 6:
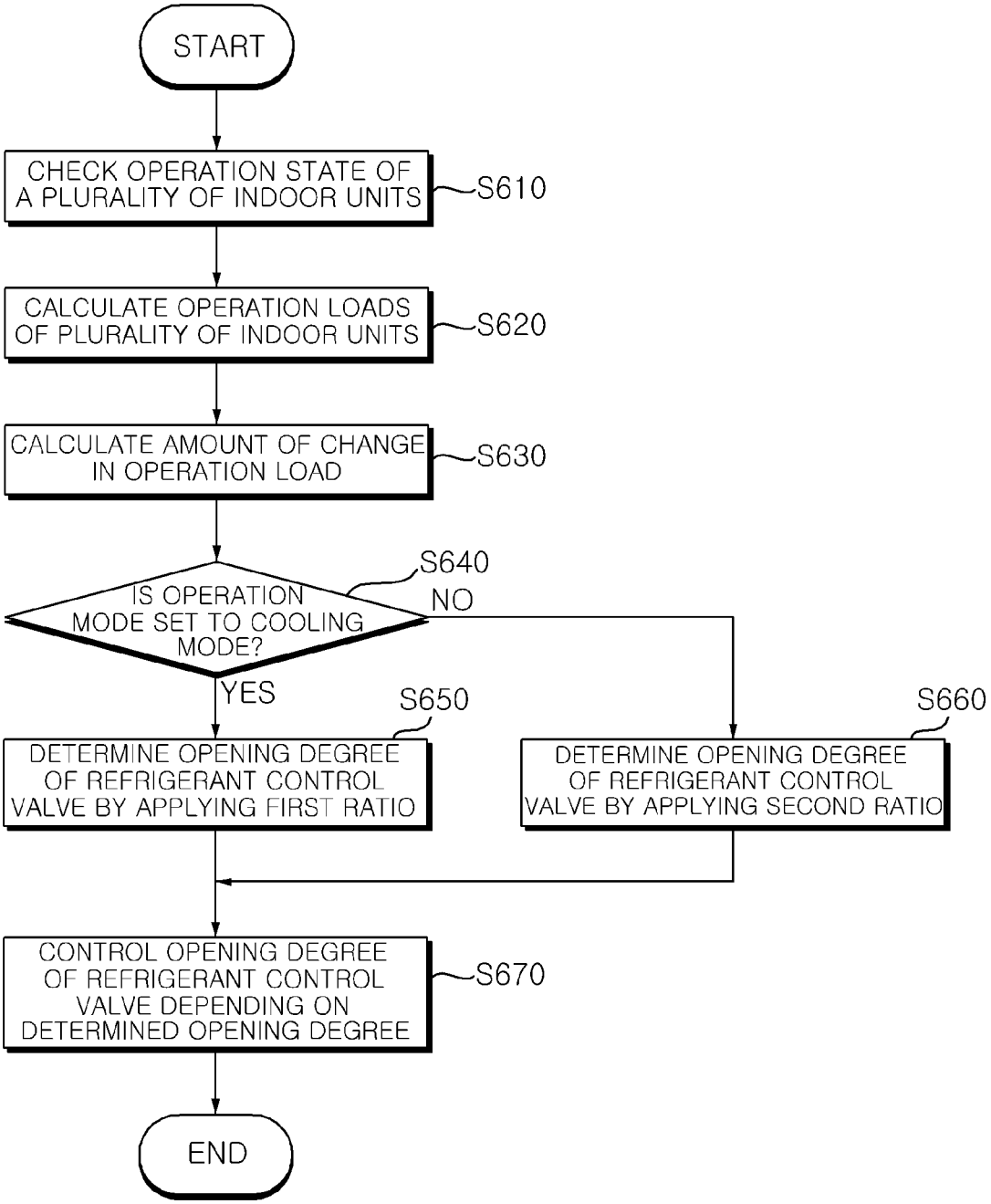
FIG. 6 is a flowchart of a method for operating a heat pump according to an embodiment.

FIG. 6 is a flowchart of a method for operating a heat pump according to an embodiment. Referring to FIG. 6, the heat pump 10 may check the operation state of the plurality of indoor units 300 in operation S610. For example, the heat pump 10 may check power on/off, the set temperature, the indoor temperature, and/or the operation mode, power consumption, for example, of the plurality of indoor units 300.

In operation S620, the heat pump 10 may calculate the operation loads of the plurality of indoor units 300 based on the operation state of the plurality of indoor units 300. For example, the heat pump 10 may calculate an operation load of an indoor unit which is powered off among the plurality of indoor units 300 as zero.

In operation S630, the heat pump 10 may calculate the amount of change in the operation load for the indoor unit 300 connected to the fluid-refrigerant heat exchanger 211 based on the operation loads of the plurality of indoor units 300. For example, when the operation load of the indoor unit 300 connected to the fluid-refrigerant heat exchanger 211 is reduced from 50 kBTU (kilo British thermal unit) to 25 kBTU, the heat pump 10 may calculate the amount of change in the operation loads of the indoor units 300 connected to the fluid-refrigerant heat exchanger 211 as −50%.

In operation S640, the heat pump 10 may check whether the operation mode of the indoor unit 300 connected to the fluid-refrigerant heat exchanger 211 is the cooling mode or the heating mode. In operation S650, the heat pump 10 may determine the opening degree of the refrigerant control valve 231 by applying the first ratio when the operation mode of the indoor unit 300 connected to the fluid-refrigerant heat exchanger 211 is the cooling mode. For example, when the amount of change in the operation load is −50%, the heat pump 10 may determine a value reduced by 50% from the previous opening degree as the opening degree of the refrigerant control valve 231 by applying the first ratio, for example, 100%.

In operation S660, the heat pump 10 may determine the opening degree of the refrigerant control valve 231 by applying the second ratio when the operation mode of the indoor unit 300 connected to the fluid-refrigerant heat exchanger 211 is the heating mode. In this case, the second ratio may be a value smaller than the first ratio. For example, when the amount of change in the operation load is −50%, the heat pump 10 may determine a value reduced by 30% from the previous opening degree as the opening degree of the refrigerant control valve 231 by applying the second ratio (e.g., 60%).

In operation S670, the heat pump 10 may control the opening degree of the refrigerant control valve 231 with the determined opening degree. For example, the heat pump 10 may control the opening degree by controlling a pulse value input to the refrigerant control valve 231 based on the determined opening degree.

Figure 7A:
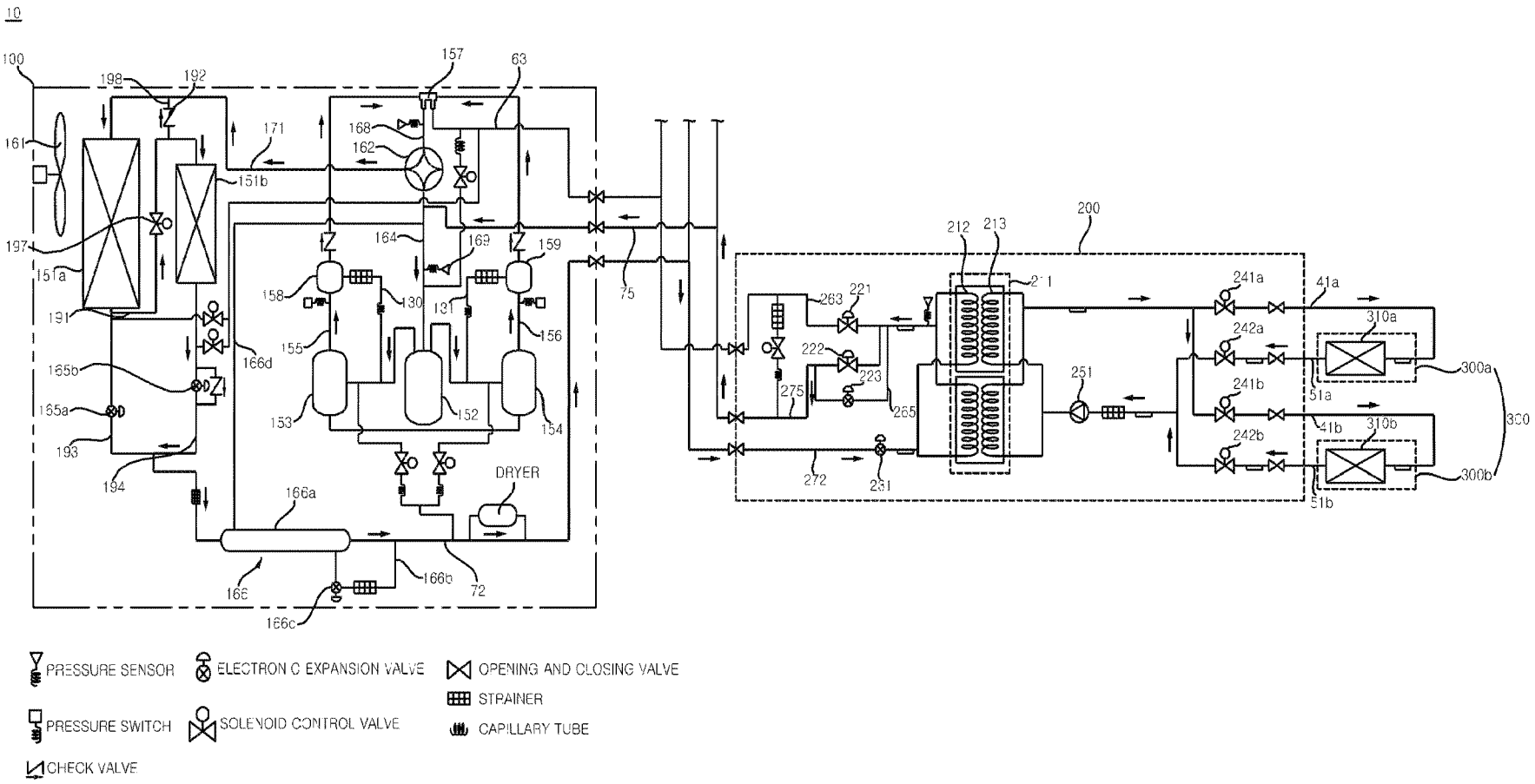
FIGS. 7A-7B and 8A-8B are diagrams for describing operation of a heat pump according to an embodiment.
Figure 7B:
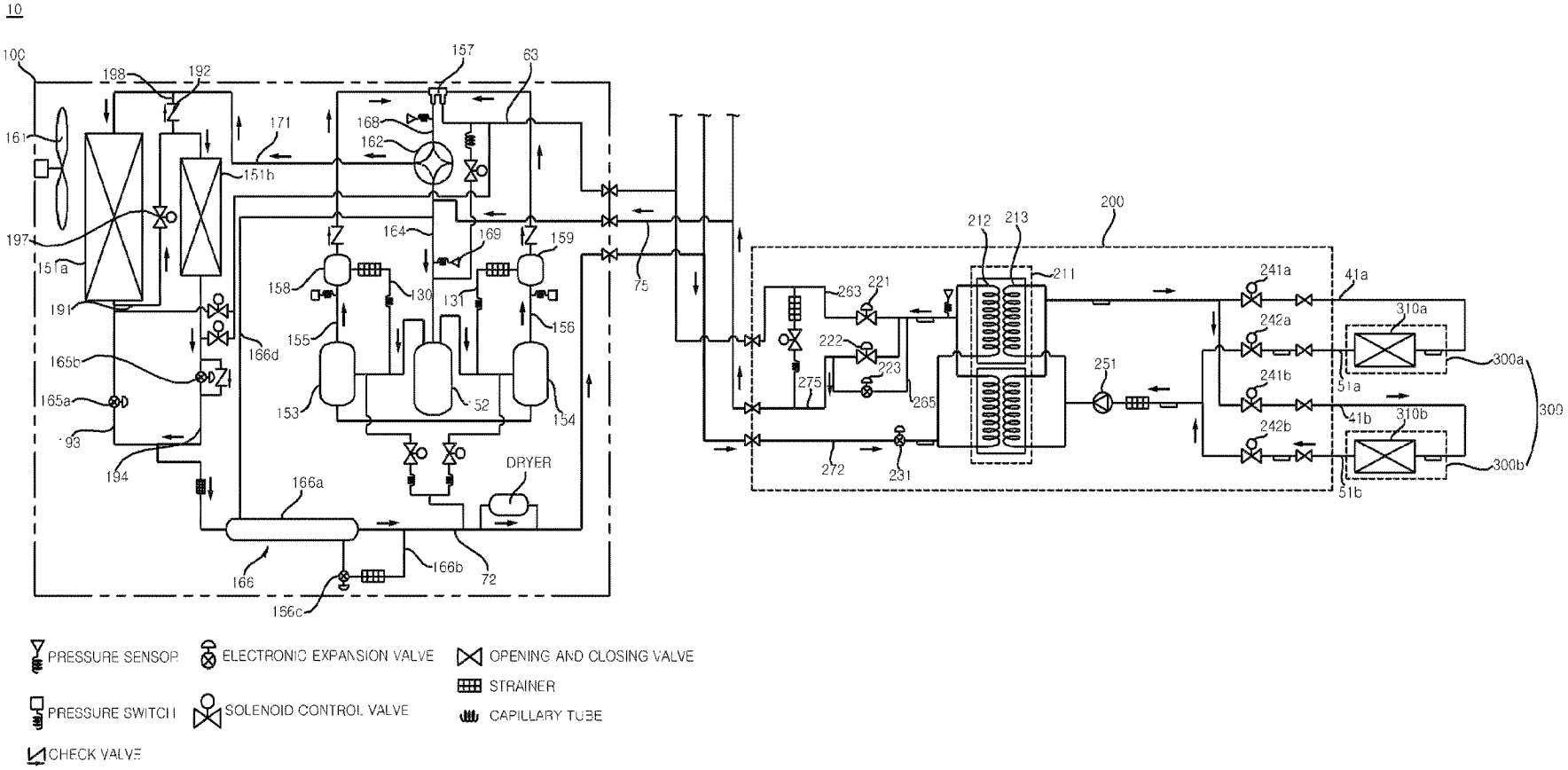

FIGS. 7A-7B and 8A-8B are diagrams for describing operation of a heat pump according to an embodiment. That is, FIGS. 7A and 7B are diagrams for describing operation of the heat pump 10 with the change in the operation load of the indoor unit 300 connected to the fluid-refrigerant heat exchanger 211 when the heat pump 10 includes one fluid-refrigerant heat exchanger 211.

Referring to FIG. 7A, when the cooling operation is performed according to the same setting while the plurality of indoor units 300 included in the heat pump 10 are all powered on, the operation mode of the heat pump 10 may be set to the cooling mode. In this case, the high-temperature, high-pressure gaseous refrigerant compressed and discharged by the compressors 153 and 154 of the outdoor unit 100 may be supplied to the fluid-refrigerant heat exchanger 211 of the hybrid unit 200, and the high-temperature fluid heat-exchanged with the high-temperature, high-pressure gaseous refrigerant in the fluid-refrigerant heat exchanger 211 may be supplied to the indoor unit 300.

Referring to FIG. 7B, as the first indoor unit 300*a* is powered off, the amount of change in the total operation load for all of the plurality of indoor units 300 and the amount of change in the operation load connected to the fluid-refrigerant heat exchanger 211 may be all calculated as −50%. In this case, the heat pump 10 may control the compressor driver 520 such that the operating frequency of the compressors 153 and 154 is reduced by 50% based on the amount of change in the total operation load. In addition, the heat pump 10 may control the opening degree of the refrigerant control valve 231 to be reduced by 50% based on the amount of change in the operation load of the indoor unit connected to the fluid-refrigerant heat exchanger 211.

Figure 8A:
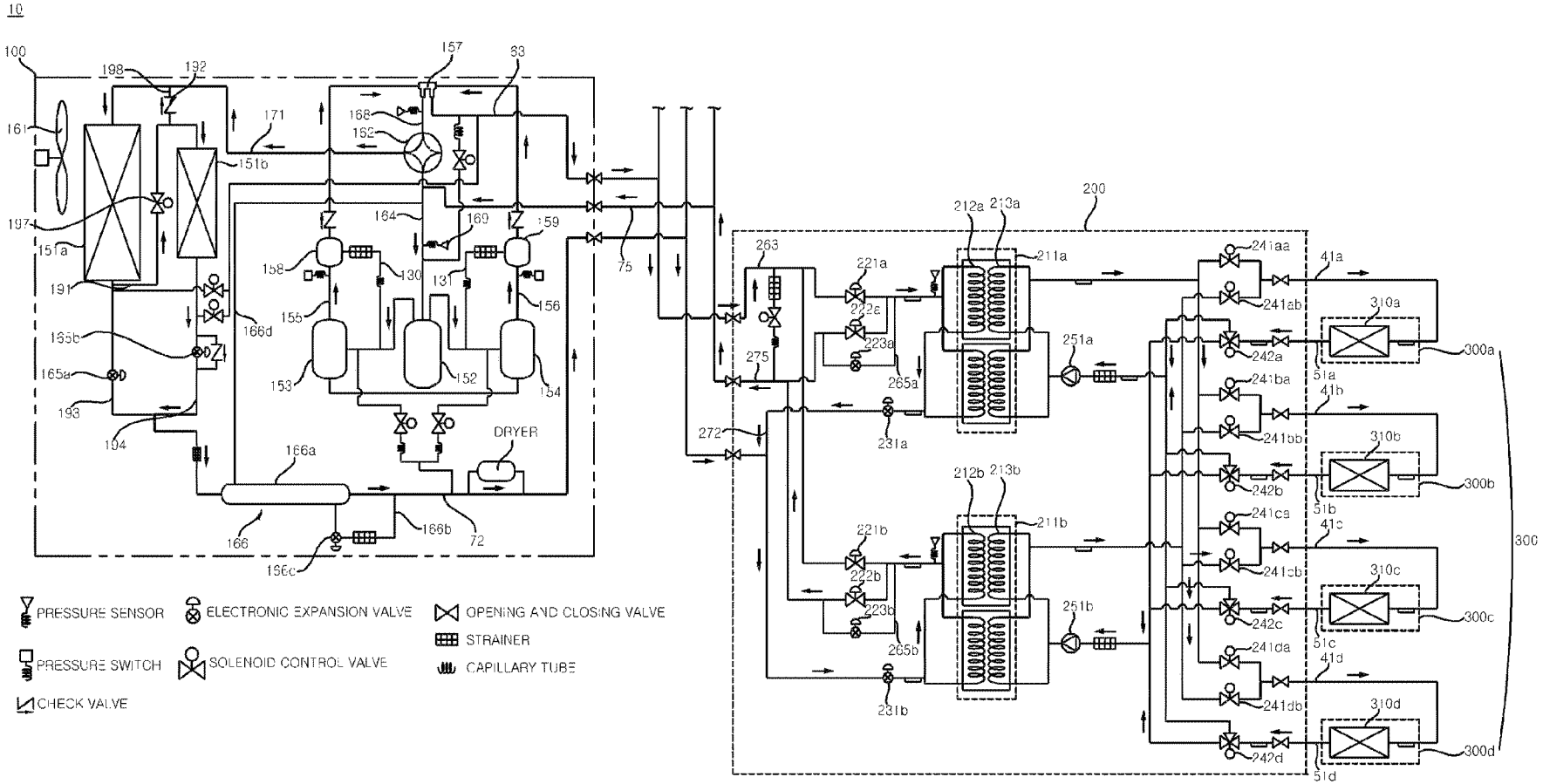
Figure 8B:
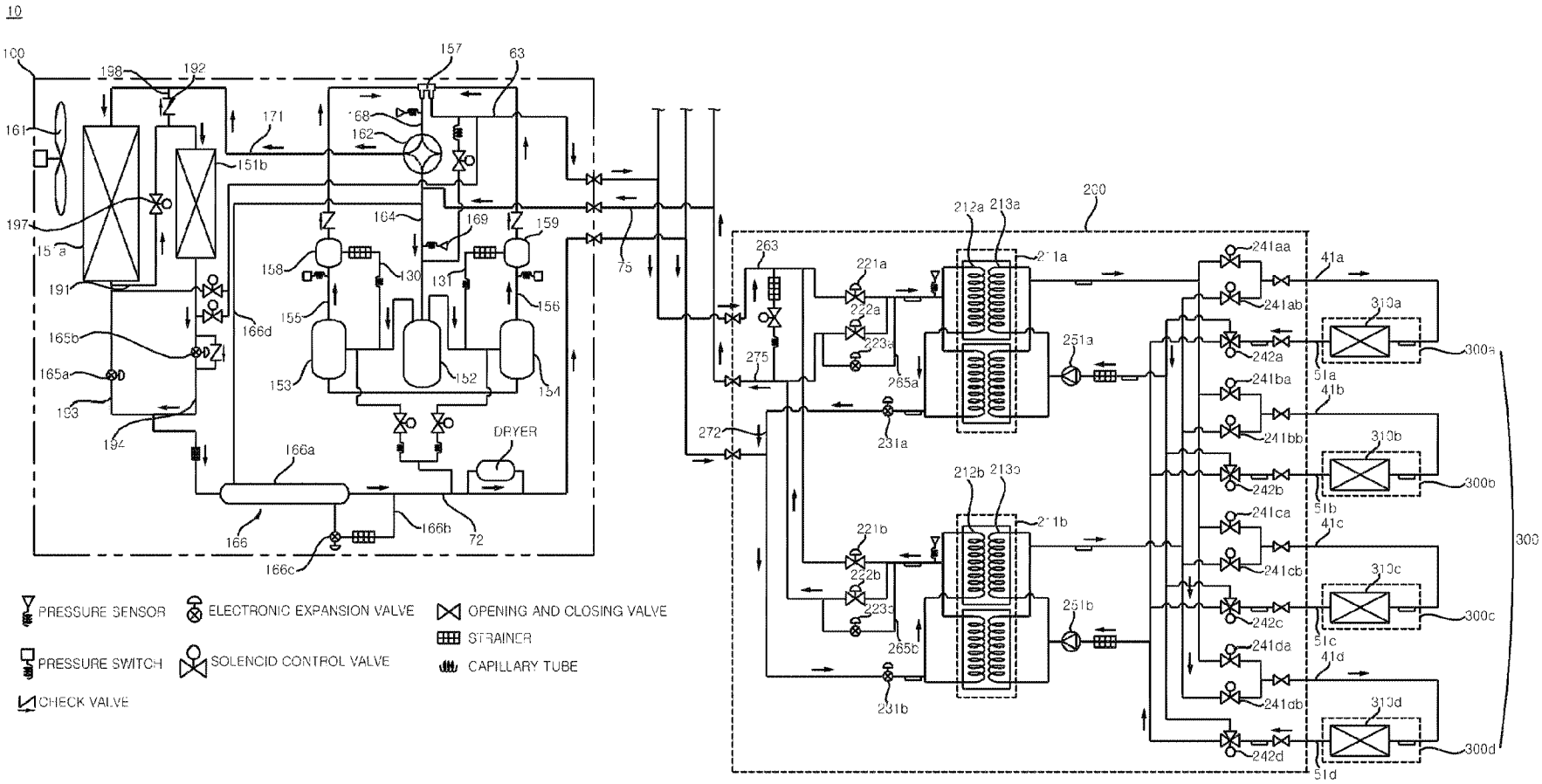

FIGS. 8A and 8B are diagrams for describing operation of the heat pump 10 with the change in the operation load of the indoor units 300 connected to a plurality of fluid-refrigerant heat exchangers 211*a* and 211*b*, respectively, when the heat pump 10 includes a plurality of fluid-refrigerant heat exchangers 211*a* and 211*b*. Referring to FIG. 8A, when the operation mode of the first and second indoor units 300*a* and 300*b* is set to the cooling mode, and the operation mode of the third and fourth indoor units 300*c* and 300*d* is set to be the heating mode among the plurality of indoor units 300 included in the heat pump 10, the operation mode of the heat pump 10 may be set to the cooling/heating mode.

In this case, at least some of the high-temperature, high-pressure gaseous refrigerant compressed and discharged by the compressors 153 and 154 of the outdoor unit 100 may be supplied to the hybrid unit 200 through the high-pressure gas pipe 63, and the remaining gaseous refrigerant that is not supplied to the hybrid unit 200 may be transferred to the outdoor heat exchangers 151*a* and 151*b*. The liquid refrigerant may be transferred from the outdoor heat exchangers 151*a* and 151*b* to the liquid pipe 72 by the heat exchange between the gaseous refrigerant and outdoor air in the outdoor heat exchangers 151*a* and 151*b*, and the liquid refrigerant may be supplied to the hybrid unit 200 through the liquid pipe 72.

The high-temperature fluid heat-exchanged with the high-temperature, high-pressure gaseous refrigerant in the first fluid-refrigerant heat exchanger 211*a* may be supplied to the first and second indoor units 300*a* and 300*b*. The low-temperature fluid heat-exchanged with the liquid refrigerant in the second fluid-refrigerant heat exchanger 211*b* may be supplied to the third and the fourth indoor units 300*c* and 300*d*.

Referring to FIG. 8B, as the second and fourth indoor units 300*b* and 300*d* are powered off, the total amount of change in the total operation load for all of the plurality of indoor units 300 may be calculated as −50%. In this case, the heat pump 10 may control the compressor driver 520 such that the operating frequency of the compressors 153 and 154 is reduced by 50% based on the amount of change in the total operation load.

The amount of change in an operation load for an indoor unit connected to the first fluid-refrigerant heat exchanger 211*a* and the amount of change in an operation load for an indoor unit connected to the second fluid-refrigerant heat exchanger 211*b* may be all calculated as −50%. In this case, as the operation mode of the indoor unit connected to the first fluid-refrigerant heat exchanger 211*a* is set to the heating mode, the heat pump 10 may perform control such that the opening degree of the first refrigerant control valve 231*a* is reduced by 30% by applying −50%, which is the amount of change in the operation load for the indoor unit connected to the first fluid-refrigerant heat exchanger 211*a*, by the second ratio, for example, 60%. As the operation mode of the indoor unit connected to the second fluid-refrigerant heat exchanger 211*b* is set to the cooling mode, the heat pump 10 may perform control such that the opening degree of the second refrigerant control valve 231*b* is reduced by 50% by applying −50%, which is the amount of change in the operation load for the indoor unit connected to the second fluid-refrigerant heat exchanger 211*b*, by the first ratio, for example, 100%.

As described above, according to embodiments disclosed herein, by supplying fluid heat-exchanged with refrigerant to the indoor unit 300 and providing cooling and heating functions using heat exchange between the fluid and the indoor air, it is possible to prevent generation of noise due to vibration of a pipe due to the flow of the refrigerant, and reduce the possibility of fire due to leakage of the refrigerant, thereby improving reliability and safety of the product.

In addition, according to embodiments disclosed herein, by accurately controlling the amount of refrigerant discharged from the outdoor unit 100 and heat-exchanged with fluid by controlling the opening degree of the refrigerant control valve 231 based on the operation loads of the plurality of indoor units 300 without controlling the refrigerant control valve 231 based only on the pipe temperature, it is possible to properly evaporate/condense the refrigerant, thereby preventing damage to the compressors 153 and 154 and improving operating efficiency of the heat pump 10.

In addition, according to embodiments disclosed herein, by providing a plurality of fluid-refrigerant heat exchangers 211*a* and 211*b* and supplying fluid from one of the plurality of fluid-refrigerant heat exchangers 211*a* and 211*b* to the indoor unit 300 according to the operation mode, it is possible to simultaneously provide the cooling function and the heating function to a plurality of indoor spaces, thereby improving usability and satisfaction of the product.

The accompanying drawings are merely intended to make easily understood embodiments disclosed, and the technical spirit disclosed in this specification is not restricted by the accompanying drawings and includes all modifications, equivalents, and substitutions which fall within the spirit and technological scope of the present disclosure.

Similarly, while operations are depicted in a particular order, this should not be understood as requiring that such operations be performed in the particular order shown or in sequential order, or that all illustrated operations be performed in order to achieve desirable results. In certain circumstances, multitasking and parallel processing may be advantageous.

Embodiments disclosed herein provide at least the following advantages.

First, embodiments disclosed herein provide a heat pump capable of providing cooling and heating functions by using a hybrid unit supplying fluid heat-exchanged with refrigerant to an indoor unit and the indoor unit performing heat exchange between the fluid and indoor air, and a method for operating a heat pump. Second, embodiments disclosed herein provide a heat pump capable of accurately controlling an amount of refrigerant discharged from an outdoor unit based on operation loads of a plurality of indoor units that provide cooling and heating functions using a fluid, such as water, and a method for operating a heat pump. Third, embodiments disclosed herein provide a heat pump capable of simultaneously providing a cooling function and a heating function to a plurality of indoor spaces in providing a cooling function and a heating function using a fluid, such as water, and a method for operating a heat pump.

Embodiments disclosed herein are not limited to the above-mentioned advantages, and other advantages not mentioned will be apparent to those skilled in the art upon reading the description.

Embodiments disclosed herein provide a heat pump that may include a fluid-refrigerant heat exchanger that performs heat exchange between a refrigerant and a fluid, such as water and supplies the fluid to a plurality of indoor units, thereby being capable of controlling an opening degree of a refrigerant control valve that controls an amount of refrigerant flowing through the fluid-refrigerant heat exchanger, based on operation loads depending on operation states of the plurality of indoor units. The heat pump may include an outdoor unit including a compressor that compresses a refrigerant and an outdoor heat exchanger that exchanges heat between the refrigerant and outdoor air, a hybrid unit including a fluid-refrigerant heat exchanger that exchanges heat between the refrigerant supplied from the outdoor unit and fluid, and a refrigerant control valve that controls an amount of refrigerant flowing through the fluid-refrigerant heat exchanger, a plurality of indoor units each including an indoor heat exchanger that exchanges heat between fluid supplied from the hybrid unit and indoor air, and a controller configured to calculate operation loads of the plurality of indoor units to control an opening degree of the refrigerant control value.

The controller may be configured to calculate the operation loads based on at least one of power on/off, a set temperature, an indoor temperature, an operation mode, or power consumption of the plurality of indoor units, calculate an amount of change in the operation load for an indoor unit connected to the fluid-refrigerant heat exchanger, based on the calculated operation load, and determine an opening degree of the refrigerant control valve based on the calculated amount of change in the operation load. The controller may be configured to determine the opening degree of the refrigerant control valve by applying the amount of change in the operation load by a first ratio, when the operation mode of the indoor unit connected to the fluid-refrigerant heat exchanger is a cooling mode, and determine the opening degree of the refrigerant control valve by applying the amount of change in the operation load by a second ratio which is smaller than the first ratio, when the operation mode of the indoor unit connected to the fluid-refrigerant heat exchanger is a heating mode. The controller may be configured to calculate the amount of change in the operation load for all of the plurality of indoor units, based on the calculated operation loads, and determine an operating frequency of the compressor based on the amount of change in the operation load for all of the plurality of indoor units.

The fluid-refrigerant heat exchanger of the heat pump may be connected to a high-pressure pipe through which a high-pressure gaseous refrigerant flows, a low-pressure pipe through which a low-pressure gaseous refrigerant flows, and a liquid pipe through which a liquid refrigerant flows. The refrigerant control valve may be disposed in the liquid pipe.

The hybrid unit may include a plurality of the fluid-refrigerant heat exchangers and a plurality of the refrigerant control valves respectively corresponding to the plurality of fluid-refrigerant heat exchangers. Each of the plurality of indoor units may be connected to two or more of the plurality of fluid-refrigerant heat exchangers and receive the fluid from any one of the connected two or more fluid-refrigerant heat exchangers depending on the operation mode.

The controller may be configured to calculate each of a first amount of change in a first operation load for an indoor unit connected to a first fluid-refrigerant heat exchanger and a second amount of change in a second operation load for an indoor unit connected to a second fluid-refrigerant heat exchanger, among the plurality of fluid-refrigerant heat exchangers, determine an opening degree of a first refrigerant control valve for controlling an amount of refrigerant flowing through the first fluid-refrigerant heat exchanger, based on the amount of change in the first operation load, and determine an opening degree of a second refrigerant control valve for controlling an amount of refrigerant flowing through the second fluid-refrigerant heat exchanger, based on the amount of change in the second operation load.

Embodiments disclosed herein provide a method for operating a heat pump. The method may include calculating operation loads of a plurality of indoor units, and controlling an opening degree of a refrigerant control valve for controlling an amount of refrigerant flowing through a fluid-refrigerant heat exchanger that exchanges heat between the refrigerant and a fluid, such as water, based on operation loads of plurality of indoor units.

According to embodiments disclosed herein, by supplying a fluid, such as water heat-exchanged with a refrigerant to the indoor unit and providing cooling and heating functions using heat exchange between the fluid and the indoor air, it is possible to prevent generation of noise due to vibration of a pipe due to the flow of the refrigerant, and reduce the possibility of fire due to leakage of the refrigerant, thereby improving reliability and safety of the product. Further, according to embodiments disclosed herein, by accurately controlling the amount of refrigerant discharged from the outdoor unit based on the operation loads of the plurality of indoor units, it is possible to properly evaporate/condense the refrigerant, thereby preventing damage to a compressor and improving operating efficiency of the heat pump.

Furthermore, according to embodiments disclosed herein, by providing a plurality of fluid-refrigerant heat exchangers and supplying a fluid, such as water from one of the plurality of fluid-refrigerant heat exchangers to the indoor unit according to the operation mode, it is possible to simultaneously provide the cooling function and the heating function to a plurality of indoor spaces, thereby improving usability and satisfaction of the product.

A further scope of applicability of embodiments disclosed herein will become apparent from the description. However, various changes and modifications made within the spirit and scope could be clearly understood by those skilled in the art, and thus, it should be understood that the description and embodiments are given by way of example only.

It will be apparent that, although embodiments have been illustrated and described above, the embodiments are not limited to the above-described specific embodiments, and various modifications may be made by those skilled in the art without departing from the gist as claimed in the appended claims. The modifications should not be understood separately from the technical spirit or prospect.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A heat pump, comprising:

an outdoor unit including a compressor that compresses a refrigerant and at least one outdoor heat exchanger that exchanges heat between the refrigerant and outdoor air;

a hybrid unit including at least one fluid-refrigerant heat exchanger that exchanges heat between the refrigerant supplied from the outdoor unit and a fluid, and at least one refrigerant control valve that controls an amount of the refrigerant flowing through the at least one fluid-refrigerant heat exchanger;

a plurality of indoor units each including an indoor heat exchanger that exchanges heat between the fluid supplied from the hybrid unit and indoor air; and a controller configured to:

calculate operation loads of the plurality of indoor units;

calculate an amount of change in a total operation load of the plurality of indoor units based on a difference between previously calculated operation loads of the plurality of indoor units and the calculated operation loads of the plurality of indoor units;

when an operation mode of the plurality of indoor units connected to the at least one fluid-refrigerant heat exchanger is a cooling mode, determine an opening degree of the at least one refrigerant control valve according to a first value obtained by multiplying the amount of change in the total operation load by a first ratio;

when the operation mode is a heating mode, determine the opening degree of the at least one refrigerant control valve according to a second value obtained by multiplying the amount of change in the total operation load by a second ratio that is smaller than the first ratio; and control the at least one refrigerant control valve based on the determined opening degree of the at least one refrigerant control valve, wherein the opening degree of the at least one refrigerant control valve increases as the amount of change in the total operation load increases.

2. The heat pump of claim 1, wherein the controller is configured to:

calculate the operation loads of the plurality of indoor units based on at least one of power on/off, a predetermined temperature, an indoor temperature, the operation mode, or power consumption of the plurality of indoor units.

3. The heat pump of claim 1, wherein the controller is configured to:

determine an operating frequency of the compressor based on the amount of change in the total operation load of the plurality of indoor units.

4. The heat pump of claim 3, wherein the at least one fluid-refrigerant heat exchanger is connected to a high-pressure pipe through which high-pressure gaseous refrigerant flows, a low-pressure pipe through which low-pressure gaseous refrigerant flows, and a liquid pipe through which liquid refrigerant flows, and wherein the at least one refrigerant control valve is disposed in a path of the hybrid unit connected to the liquid pipe.

5. The heat pump of claim 4, wherein the at least one fluid-refrigerant heat exchanger comprises a plurality of the fluid-refrigerant heat exchangers and the at least one control valve comprises a plurality of the refrigerant control valves respectively corresponding to the plurality of fluid-refrigerant heat exchangers, and wherein each of the plurality of indoor units is connected to two or more of the plurality of fluid-refrigerant heat exchangers, and receives the fluid from any one of the two or more fluid-refrigerant heat exchangers depending on the operation mode.

6. The heat pump of claim 5, wherein when calculating the amount of change in the total operation load of the plurality of indoor units and controlling the at least one refrigerant control valve, the controller is configured to:

calculate each of a first amount of change in a first operation load for an indoor unit, of the plurality of indoor units, connected to a first fluid-refrigerant heat exchanger of the plurality of fluid-refrigerant heat exchangers and a second amount of change in a second operation load for an indoor unit, of the plurality of indoor units, connected to a second fluid-refrigerant heat exchanger of the plurality of fluid-refrigerant heat exchangers;

determine an opening degree of a first refrigerant control valve of the plurality of refrigerant control valves that controls an amount of the refrigerant flowing through the first fluid-refrigerant heat exchanger, based on the first amount of change in the first operation load; and determine an opening degree of a second refrigerant control valve of the plurality of refrigerant control valves that controls an amount of the refrigerant flowing through the second fluid-refrigerant heat exchanger, based on the second amount of change in the second operation load.

7. The heat pump of claim 1, wherein the outdoor unit further comprises:

an accumulator that temporarily stores gasified refrigerant; and a cooling/heating switching valve that switches a flow path of the compressed refrigerant.

8. The heat pump of claim 7, wherein the controller is configured to control operation of the cooling/heating switching valve based on the operation mode.

9. The heat pump of claim 1, wherein the at least one outdoor heat exchanger comprises a plurality of outdoor heat exchangers.

10. A method for operating a heat pump including an outdoor unit, a hybrid unit, and a plurality of indoor units, the method comprising:

calculating operation loads of the plurality of indoor units;

calculating an amount of change in a total operation load of the plurality of indoor units based on a difference between previously calculated operation loads of the plurality of indoor units and the calculated operation loads of the plurality of indoor units;

when an operation mode of the plurality of indoor units connected to at least one fluid-refrigerant heat exchanger that exchanges heat between a refrigerant and a fluid is a cooling mode, determining an opening degree of at least one refrigerant control valve of the hybrid unit according to a first value obtained by multiplying the amount of change in the total operation load by a first ratio, wherein the at least one refrigerant control valve controls an amount of the refrigerant flowing through the at least one fluid-refrigerant heat exchanger;

when the operation mode is a heating mode, determining the opening degree of the at least one refrigerant control valve according to a second value obtained by multiplying the amount of change in the total operation load by a second ratio that is smaller than the first ratio; and controlling the at least one refrigerant control valve based on the determined opening degree of the at least one refrigerant control valve, wherein the opening degree of the at least one refrigerant control valve increases as the amount of change in the total operation load increases.

11. The method of claim 10, wherein the outdoor unit includes a compressor that compresses the refrigerant and an outdoor heat exchanger that exchanges heat between the refrigerant and outdoor air, wherein the at least one fluid-refrigerant heat exchanger receives the refrigerant from the outdoor unit, and wherein each of the plurality of indoor units includes an indoor heat exchanger that exchanges heat between the fluid supplied from the hybrid unit and indoor air.

12. The method of claim 11, wherein the calculating of the operation loads of the plurality of indoor units includes calculating the operation loads of the plurality of indoor units based on at least one of power on/off, a predetermined temperature, an indoor temperature, the operation mode, or power consumption of the plurality of indoor units.

13. The method of claim 10, further comprising:

determining an operating frequency of the compressor based on the amount of change in the total operation load of the plurality of indoor units.

14. The method of claim 13, wherein the at least one fluid-refrigerant heat exchanger is connected to a high-pressure pipe through which high-pressure gaseous refrigerant flows, a low-pressure pipe through which low-pressure gaseous refrigerant flows, and a liquid pipe through which liquid refrigerant flows, and wherein the at least one refrigerant control valve is disposed in a path of the hybrid unit connected to the liquid pipe.

15. The method of claim 14, wherein the at least one fluid-refrigerant heat exchanger comprises a plurality of the fluid-refrigerant heat exchangers and the at least one refrigerant control valve comprises a plurality of the refrigerant control valves respectively corresponding to the plurality of fluid-refrigerant heat exchangers, and wherein each of the plurality of indoor units is connected to two or more of the plurality of fluid-refrigerant heat exchangers, and receives the fluid from any one of the two or more fluid-refrigerant heat exchangers depending on the operation mode.

16. The method of claim 15, wherein the calculating of the amount of change in the total operation load of the plurality of indoor units and the controlling of the at least one refrigerant control valve further comprise:

calculating each of a first amount of change in a first operation load for an indoor unit, of the plurality of indoor units, connected to a first fluid-refrigerant heat exchanger of the plurality of fluid-refrigerant heat exchangers and a second amount of change in a second operation load for an indoor unit of the plurality of indoor units, connected to a second fluid-refrigerant heat exchanger of the plurality of fluid-refrigerant heat exchangers; and determining an opening degree of a first refrigerant control valve of the plurality of refrigerant control valves that controls an amount of the refrigerant flowing through the first fluid-refrigerant heat exchanger, based on the first amount of change in the first operation load, and determining an opening degree of a second refrigerant control valve of the plurality of refrigerant control valves that controls an amount of the refrigerant flowing through the second fluid-refrigerant heat exchanger, based on the second amount of change in the second operation load.

* * * * *